United States Patent [19]

Yamamoto et al.

[11] 4,455,956

[45] Jun. 26, 1984

[54] CYCLIC SEWING MACHINE

[75] Inventors: Yoshikazu Yamamoto, Inuyama; Kohzoh Sano, Toyota; Kunio Haneda, Kasugai; Toshiaki Yanagi, Nagoya, all of Japan

[73] Assignee: Brother Kogyo Kabushiki Kaisha, Nagoya, Japan

[21] Appl. No.: 300,465

[22] Filed: Sep. 8, 1981

[30] Foreign Application Priority Data

Sep. 18, 1980 [JP] Japan ..... 55-129975

[51] Int. Cl.[3] ..... D05B 69/22

[52] U.S. Cl. ..... 112/274; 112/67; 112/121.12

[58] Field of Search ..... 112/271, 274, 67, 121.11, 112/121.12

[56] References Cited

U.S. PATENT DOCUMENTS

| | | | |
|---|---|---|---|
| 3,705,561 | 12/1972 | Sakawa | 112/67 |
| 3,965,830 | 6/1976 | Dorosz | 112/121.11 |
| 4,373,461 | 2/1983 | Sano | 112/74 |

*Primary Examiner*—Peter P. Nerbun

*Attorney, Agent, or Firm*—Leydig, Voit, Osann, Mayer & Holt Ltd.

[57] ABSTRACT

A sewing machine in which the start and stop of a main shaft is controlled by a cam mechanism through a motion control mechanism at the sewing cycle corresponding to a predetermined number of stitches. The working position of a work holder is controlled by positional data in original instructions stored in a memory. Additional instruction corresponding to the number of stitches to reach the next stop time point controlled by the cam mechanism is prepared for back-tacking, unless the number of stitches corresponding to the original instructions are equal to an integral multiple of the predetermined number of stitches.

10 Claims, 37 Drawing Figures

| ADDRESS | CONTENT OF MEMORY |
|---|---|
| FROM 2000H TO 20FFH | OPERATIONAL AREA |
| FROM 2100H TO 28FFH | SEWING PROGRAM AREA |

| | B7 | B6 | B5 | B4 | B3 | B2 | B1 | B0 |
|---|---|---|---|---|---|---|---|---|
| DATA 1 FIRST BYTE | DSY Y± | DSX X± | X PULSE DXM | | | | | |
| DATA 2 SECOND BYTE | SECT. | | Y PULSE DYM | | | | | |

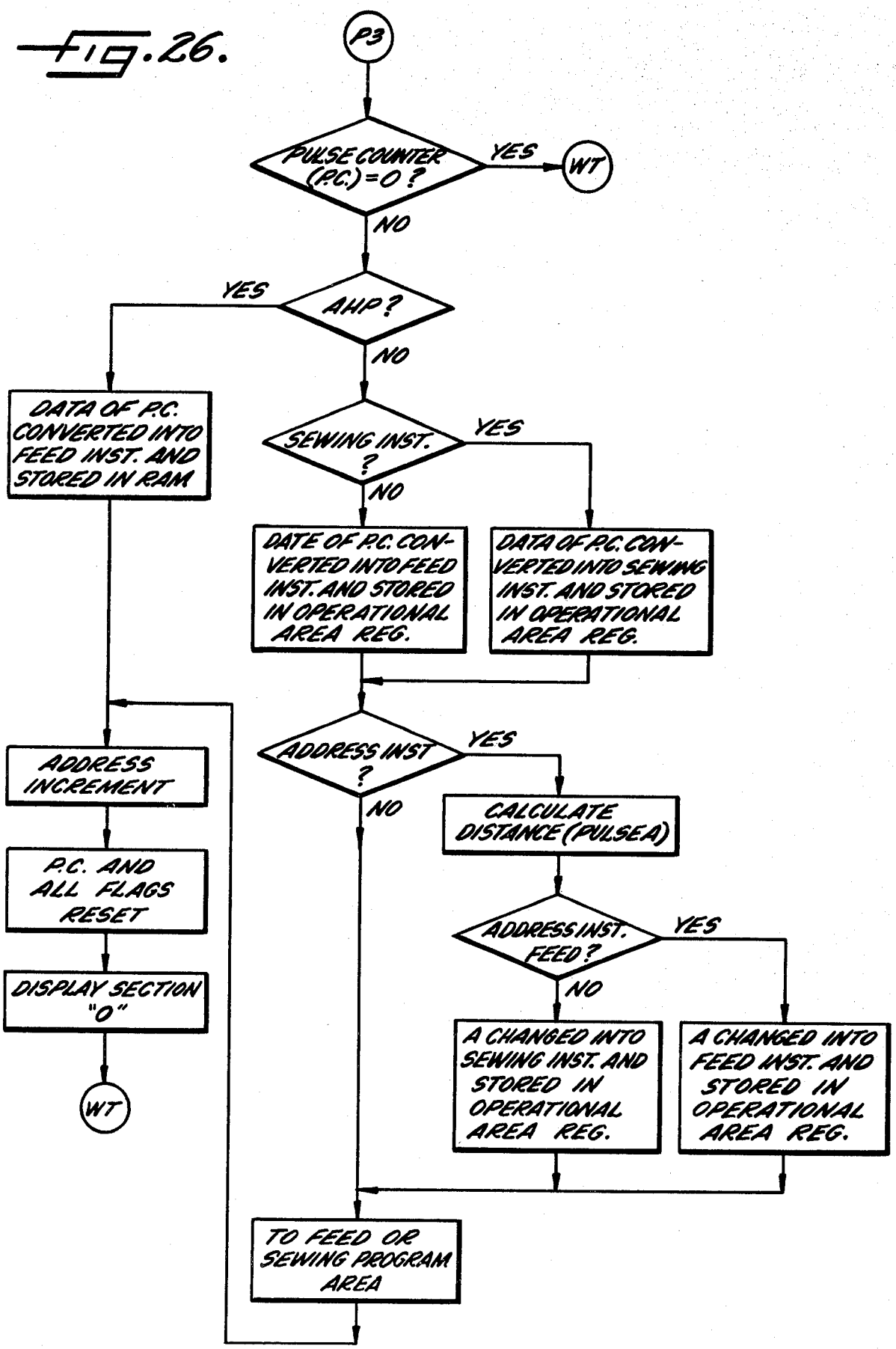
FIG. 26.
P3
PULSE COUNTER (P.C.) = 0 ?
YES
WT
NO
AHP ?
YES
NO
DATA OF P.C. CONVERTED INTO FEED INST. AND STORED IN RAM
SEWING INST. ?
YES
NO
DATE OF P.C. CONVERTED INTO FEED INST. AND STORED IN OPERATIONAL AREA REG.
DATA OF P.C. CONVERTED INTO SEWING INST. AND STORED IN OPERATIONAL AREA REG.
ADDRESS INCREMENT
ADDRESS INST ?
YES
NO
CALCULATE DISTANCE (PULSEA)
P.C. AND ALL FLAGS RESET
ADDRESS INST. FEED ?
YES
NO
DISPLAY SECTION "0"
A CHANGED INTO SEWING INST. AND STORED IN OPERATIONAL AREA REG.
A CHANGED INTO FEED INST. AND STORED IN OPERATIONAL AREA REG.
WT
TO FEED OR SEWING PROGRAM AREA

Fig. 36.

| ADDRESS | INSTRUCTION | | CONTENT OF INSTRUCTION |
|---|---|---|---|
| 2100 | 00000000 | 00 | INST. CODE OF MAGNETIC CARD |
| 1 | 01010101 | 55 | CHECK CODE OF COMPLETION PROGRAM |
| 2 | 01000111 | 47 | |
| 3 | 00011110 | 1E | NUMBER OF X-AXIS STEPS (PH-P1) |
| 4 | 00000000 | 00 | |
| 5 | 00111001 | 39 | NUMBER OF Y-AXIS STEPS (PH-P1) |
| 6 | 00000000 | 00 | |
| 7 | 10001010 | 8A | SEWING INSTRUCTION FOR ONE STITCH (P1-P2) |
| 8 | 11000100 | C4 | |
| 9 | 10001010 | 8A | " (P2-P3) |
| A | 11000100 | C4 | |
| B | 10001010 | 8A | " (P3-P4) |
| C | 11000100 | C4 | |
| D | 10001010 | 8A | " (P4-P5) |
| E | 11000100 | C4 | |
| F | 10001010 | 8A | " (P5-P6) |
| 2110 | 11000100 | C4 | |
| 1 | 10001010 | 8A | " (P6-P7) |
| 2 | 11000100 | C4 | |
| 3 | 10001010 | 8A | " (P7-P8) |
| 4 | 11000010 | C2 | |
| 5 | 10001010 | 8A | " (P8-P9) |
| 6 | 11000010 | C2 | |
| 7 | 10001010 | 8A | " (P9-P10) |
| 8 | 11000010 | C2 | |
| 9 | 10001010 | 8A | " (P10-P11) |
| A | 11000010 | C2 | |
| B | 10001010 | 8A | " (P11-P12) |
| C | 11000010 | C2 | |
| D | 10001010 | 8A | " (P12-P13) |
| E | 11000010 | C2 | |
| F | 10000101 | 85 | FEED INSTRUCTION (P13-P14) |
| 2120 | 00000001 | 01 | |
| 1 | 10000010 | 82 | |
| 2 | 00000100 | 04 | |
| 3 | 00000000 | 08 | SEWING INSTRUCTION FOR ONE STITCH (P14-P15) |
| 4 | 11000111 | C7 | |
| 5 | 00001000 | 08 | " (P15-P16) |
| 6 | 11000111 | C7 | |
| 7 | 00001000 | 08 | " (P16-P17) |
| 8 | 11000111 | C7 | |
| 9 | 00001000 | 08 | " (P17-P18) |
| A | 11000111 | C7 | |
| B | 00001000 | 08 | " (P18-P19) |
| C | 11000111 | C7 | |
| D | 10001000 | 88 | " (P19-P20) |
| E | 11000111 | C7 | |
| F | 10001000 | 88 | " (P20-P21) |
| 2130 | 11000111 | C7 | |
| 1 | 10001000 | 88 | " (P21-P22) |
| 2 | 11000111 | C7 | |
| 3 | 10001000 | 88 | " (P22-P23) |
| 4 | 11000111 | C7 | |
| 5 | 00000000 | 00 | END CODE OF PROGRAM |
| 6 | 10000000 | 80 | |

Fig. 37.

| ADDRESS | INSTRUCTION | | CONTENT OF INSTRUCTION |
|---|---|---|---|
| 2100 | 00000000 | 00 | INST. CODE OF MAGNETIC CARD |
| 1 | 01010101 | 55 | CHECK CODE OF COMPLETION PROGRAM. |
| 2 | 01000111 | 47 | |
| 3 | 00011110 | 1E | NUMBER OF X-AXIS STEPS (PH-P1) |
| 4 | 00000000 | 00 | |
| 5 | 00111001 | 39 | NUMBER OF Y-AXIS STEPS (PH-P1) |
| 6 | 00000000 | 00 | |
| 7 | 10001010 | 8A | SEWING INSTRUCTION FOR ONE STITCH (P1-P2) |
| 8 | 11000100 | C4 | |
| 9 | 10001010 | 8A | " (P2-P3) |
| A | 11000100 | C4 | |
| B | 10001010 | 8A | " (P3-P4) |
| C | 11000100 | C4 | |
| D | 10001010 | 8A | " (P4-P5) |
| E | 11000100 | C4 | |
| F | 10001010 | 8A | " (P5-P6) |
| 2110 | 11000100 | C4 | |
| 1 | 10001010 | 8A | " (P6-P7) |
| 2 | 11000100 | C4 | |
| 3 | 10001010 | 8A | " (P7-P8) |
| 4 | 11000010 | C2 | |
| 5 | 10001010 | 8A | " (P8-P9) |
| 6 | 11000010 | C2 | |
| 7 | 10001010 | 8A | " (P9-P10) |
| 8 | 11000010 | C2 | |
| 9 | 10001010 | 8A | " (P10-P11) |
| A | 11000010 | C2 | |
| B | 10001010 | 8A | " (P11-P12) |
| C | 11000010 | C2 | |
| D | 10001010 | 8A | " (P12-P13) |
| E | 11000010 | C2 | |
| F | 01001010 | 4A | SEWING INSTRUCTION FOR ONE BACK TACK (P13-P12) |
| 2120 | 11000010 | C2 | |
| 1 | 10000000 | 80 | FEED INSTRUCTION (P12-P13) |
| 2 | 00000000 | 00 | |
| 3 | 10001010 | 8A | |
| 4 | 00000010 | 02 | |
| 5 | 10000101 | 85 | FEED INSTRUCTION (P13-P14) |
| 6 | 00000001 | 01 | |
| 7 | 10000010 | 82 | |
| 8 | 00000100 | 04 | |
| 9 | 00001000 | 08 | SEWING INSTRUCTION FOR ONE STITCH (P14-P15) |
| A | 11000111 | C7 | |
| B | 00001000 | 08 | " (P15-P16) |
| C | 11000111 | C7 | |
| D | 00001000 | 08 | " (P16-P17) |
| E | 11000111 | C7 | |
| F | 00001000 | 08 | " (P17-P18) |
| 2130 | 11000111 | C7 | |
| 1 | 00001000 | 08 | " (P18-P19) |
| 2 | 11000111 | C7 | |
| 3 | 10001000 | 88 | " (P19-P20) |
| 4 | 11000111 | C7 | |
| 5 | 10001000 | 88 | " (P20-P21) |
| 6 | 11000111 | C7 | |
| 7 | 10001000 | 88 | " (P21-P22) |
| 8 | 11000111 | C7 | |
| 9 | 10001000 | 88 | " (P22-P23) |
| A | 11000111 | C7 | |
| B | 01001000 | 48 | ADDITIONAL INST. FOR ONE BACK TACK (P23-P22) |
| C | 11000111 | C7 | |
| D | 01001000 | 48 | " (P22-P21) |
| E | 11000111 | C7 | |
| F | 01001000 | 48 | " (P21-P20) |
| 2140 | 11000111 | C7 | |
| 1 | 01001000 | 48 | " (P20-P19) |
| 2 | 11000111 | C7 | |
| 3 | 00000000 | 00 | END CODE OF PROGRAM |
| 4 | 10000000 | 80 | |

CYCLIC SEWING MACHINE

FIELD OF THE INVENTION

This invention relates to a sewing machine and more particularly to a cycle sewing machine wherein each sewing operation is completed in one cycle corresponding to a predetermined number of stitches.

BACKGROUND OF THE INVENTION

A typical cycle sewing machine of this kind is illustrated in the U.S. Pat. No. 3,705,561. This sewing machine comprises first cam means rotating in gear with the main shaft of the sewing machine and adapted for actuating a motion control mechanism of the main shaft at a cycle corresponding to the predetermined number of stitches, second cam means rotating in gear with the main shaft and adapted for imparting feed motion to the work holder with a number of stitches equal to integral multiple of said predetermined number of stitches corresponding to one cycle of said first cam means and means for nullifying the operation of said motion control mechanism until second cam means has completed its rotation to impart one cycle sewing operation to the sewing machine regardless of rotation of said first cam means. Various different kinds of said second cams are made available to control the numbers of stitches that are different integral multiples of said predetermined number of stitches, these second cam means being selectively used and interchanged to enable cyclic sewing operation with occasionally different numbers of stitches.

In this prior-art sewing machine, since the motion control mechanism of the main shaft is operatively controlled with a stitch number that is some integral multiple of said predetermined number of stitches corresponding to one cycle of the first cam means, the number of practicable stitches is limited by said first cam means to some integral number times the number of stitches on which sewing operation may be halted, thus considerably restricting the freedom of the sewing operation. Since second cams of various kinds, for realizing the numbers of stitches equal to different integral multiple of said predetermined number of stitches, and motion coupling means of various kinds, (such as interchangeable transmission gear units) for realizing various speed ratios relative to main shaft rotation, are required in this prior-art sewing machine, the overall device tends to be costly and complex in structure. Moreover, because of the necessity for interchangeably and selectively mounting such second cam and motion coupling means in position in the sewing machine, a complex operation is required in advance of sewing. In addition, the number of stitches may not be selected optionally.

For overcoming such deficiency, it has been proposed in the U.S. Pat. Nos. 3,965,830 and 4,050,393 to provide a cycle sewing machine having a rotary cam rotated in gear with the main shaft and adapted to control above all the end of an operational cycle of the sewing machine. Also provided is a control means adapted to drive two step motors in accordance with positional data supplied from a semiconductor memory in timed relation with the main shaft rotation, for feeding the work holder, wherein said rotary cam is made to rotate only at the beginning and towards the end of the operating cycle under the control of said control means to effect one-cycle sewing operations with different stitch numbers.

In this kind of prior-art sewing machine, however, since the programmable read-only memory (PROM) is needed as semiconductor memory for permanent storage of positional data for the work holder, a limitation is placed on the ability of the sewing machine to perform in accordance with positional data instructions supplied from PROM such that different PROMs with respective positional data must be used interchangeably to effect various sewing operations. Moreover, such positional data must be written into the PROM by a laborious operation using a special write device.

For overcoming such deficiency, there has been devised an automatic sewing machine in which operational commands to start or stop the sewing machine and a number of instructions including positional data instructions for indicating shift positions for the work holder, may be programmed as desired, and one cycle sewing operation may be automatically performed in accordance with these programmed instructions.

In this prior-art sewing machine, however, special needle positioning means, work holding means and thread cutting means as well as a complex control system to control their operation are required with resulting increase of manufacture costs.

SUMMARY OF THE INVENTION

This invention has been made to obviate such drawbacks in the conventional sewing machines, and has as an object to provide a sewing machine wherein the start and stop of the main shaft of the sewing machine is controlled through a motion control mechanism by a cam means that is adapted to rotate in gear with said main shaft. Movement of the work holder is controlled through a control means in accordance with a plurality of instructions stored in a memory means. Excellent performance may be realized at a reduced manufacturing cost through partial remodelling of existing popular cycle sewing machines such as bar tack sewing machines.

A further object of the present invention is to provide a sewing machine wherein operation of the motion control mechanism may be controlled by said cam means with a cycle corresponding to the predetermined number of stitches. The operation of said motion control mechanism caused by said cam means may be validated by an actuating means, wherein means are provided for preparing at least one additional instruction corresponding to the number of stitches required to reach the next stop time point controlled by said cam means in case that the number of stitches corresponding to a plurality of original instructions including operational commands for said actuating means and positional data for the work holder is not consistent with the number of stitches haltable by said cam means, whereby restrictions on the number of possible stitches in one cycle of the sewing machine may be eliminated to assure freedom in the sewing operation.

A still further object of the present invention is to provide a sewing machine wherein a plurality of instructions for work holder etc. may be easily programmed by a programming operation means.

BRIEF DESCRIPTION OF THE DRAWINGS

FIGS. 24 to 35 are flow charts showing the various operational sequences to be executed by the control unit.

FIG. 36 shows the various instructions as programmed by the programming operation.

FIG. 37 shows the instructions as corrected by the card read operation.

DESCRIPTION OF PREFERRED EMBODIMENT

Figure 1:
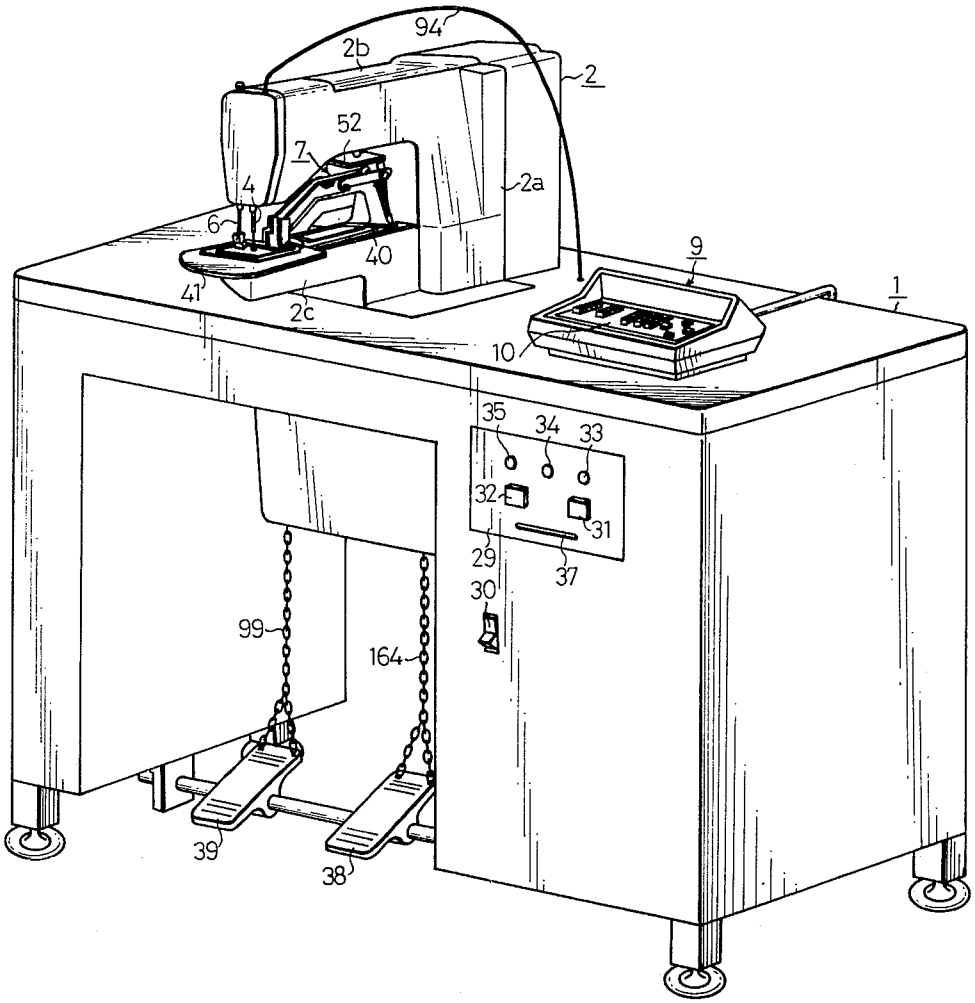
FIG. 1 is a perspective view showing the overall cycle sewing machine embodying the present invention.
Figure 2:
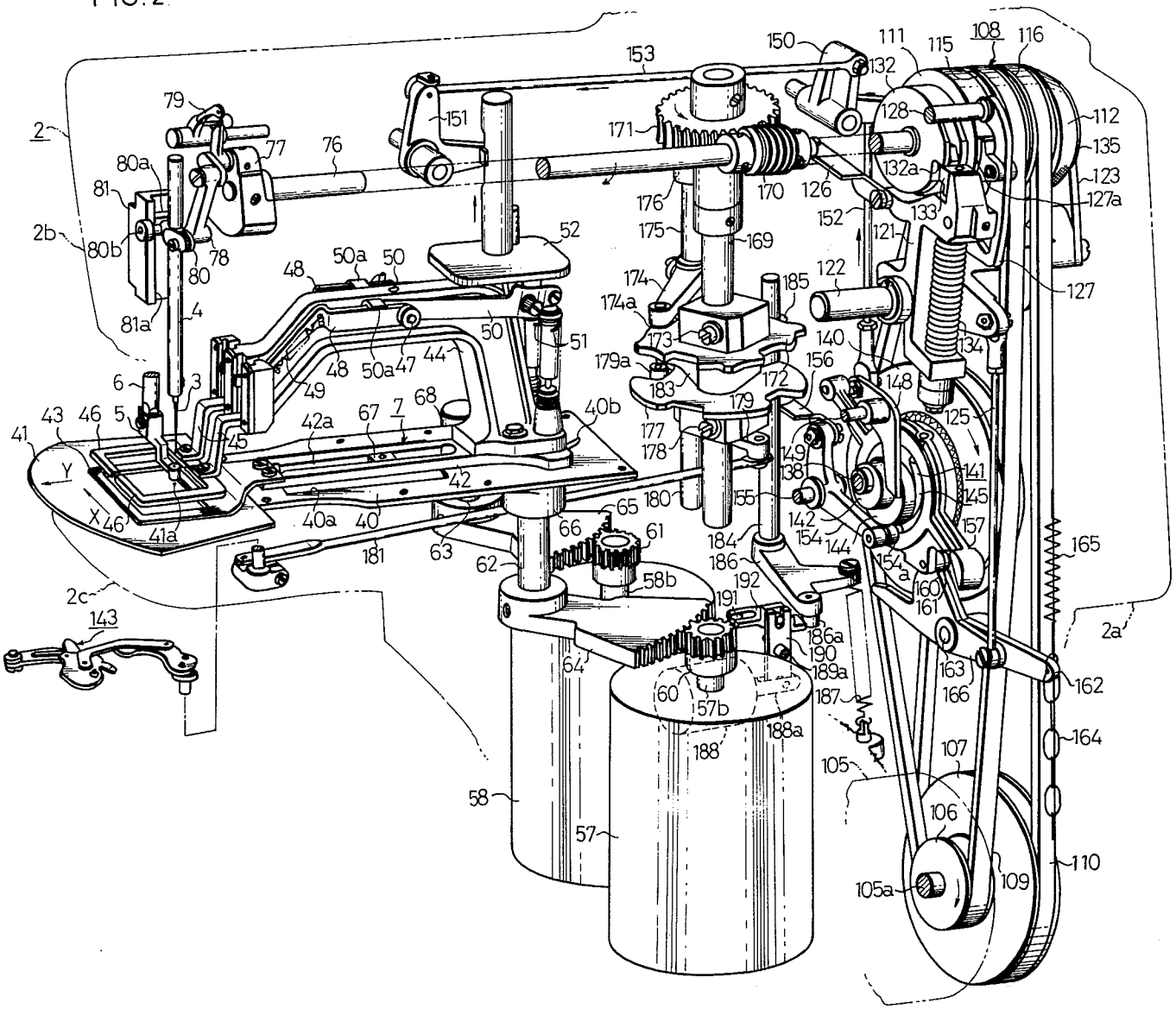
FIG. 2 is an enlarged perspective view showing the essential mechanism within the sewing machine frame.
Figure 9:
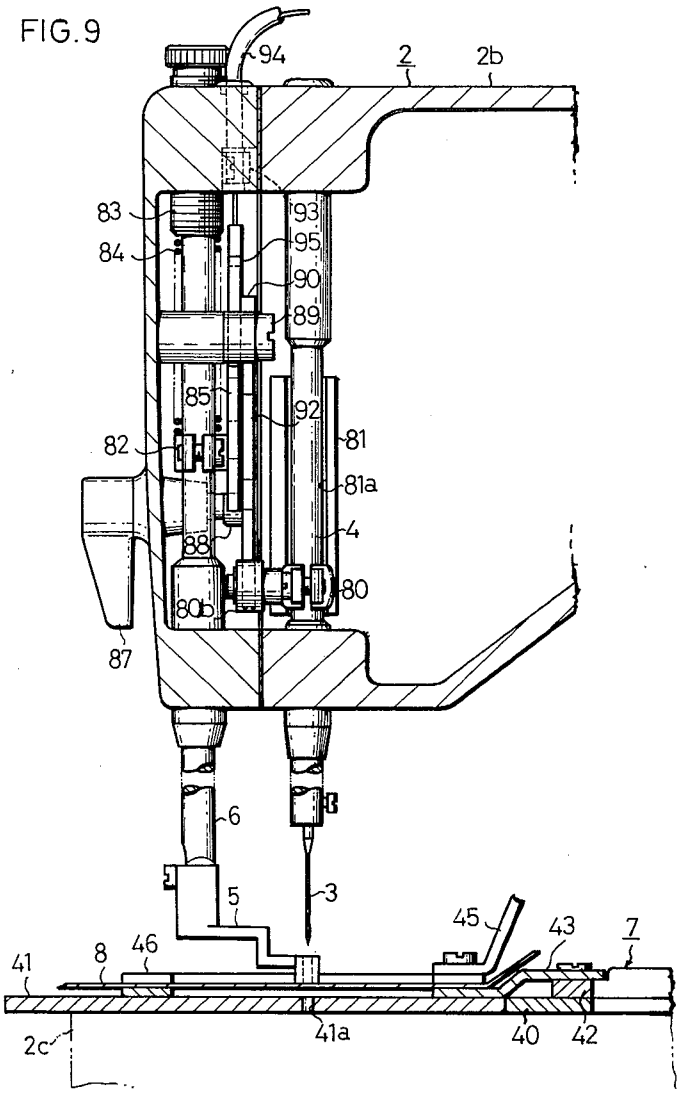
FIG. 9 is sectional view taken along line 9—9 of FIG. 8.
Figure 8:
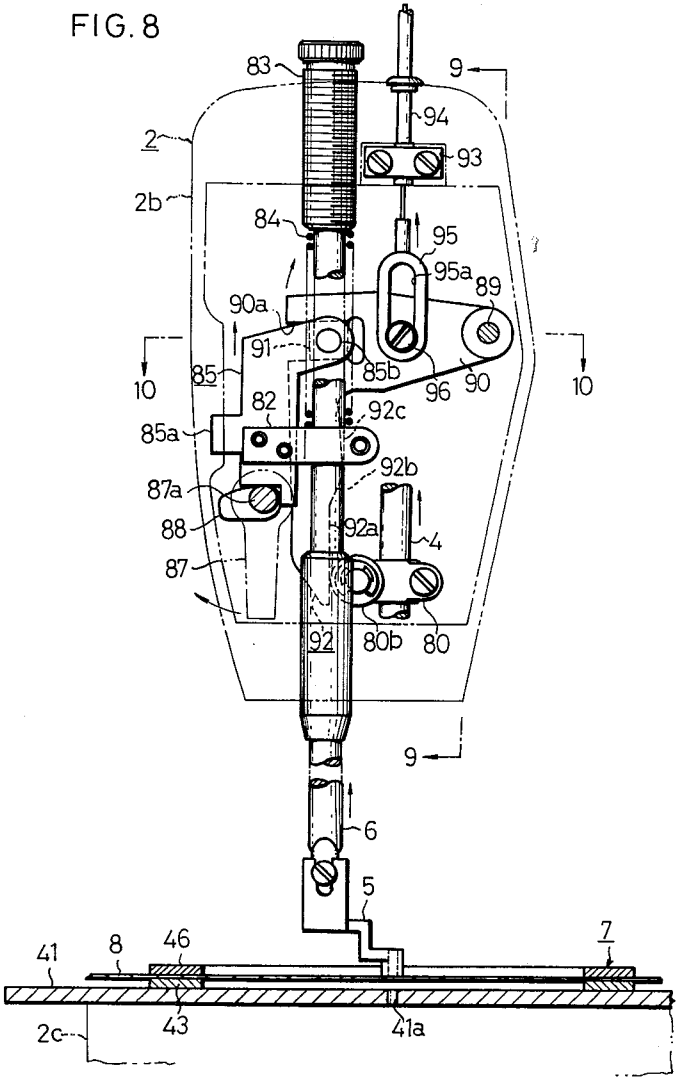
FIG. 8 is an enlarged sectional front view showing the mechanism within the bracket arm shown in FIG. 2.

Referring to the drawings illustrating the structure of a cyclic sewing machine embodying the present invention, a frame 2 of the sewing machine is placed on a table 1 and equipped with a standard 2*a*, a bracket arm 2*b* extending forwards from said standard 2*a* and a work supporting bed 2*c* extending forwards from said standard 2*a* below said bracket arm 2*b*, as shown in FIG. 1. A needle bar 4 having a needle 3 at the lower end and a presser bar 6 having a presser foot 5 as its lower end are mounted to an upper portion of said bracket arm 2*b* so as to be vertically movable. A work holder 7 or work holding means is carried on said work supporting bed 2*c* horizontally movably across a reciprocating path of the needle 3, as shown in FIG. 2. Stitches are formed in the work fabric 8 held by work holder 7, as shown in FIGS. 8 and 9, through cooperation with a loop taker, not shown, mounted in the work supporting bed 2*c*.

Figure 3:
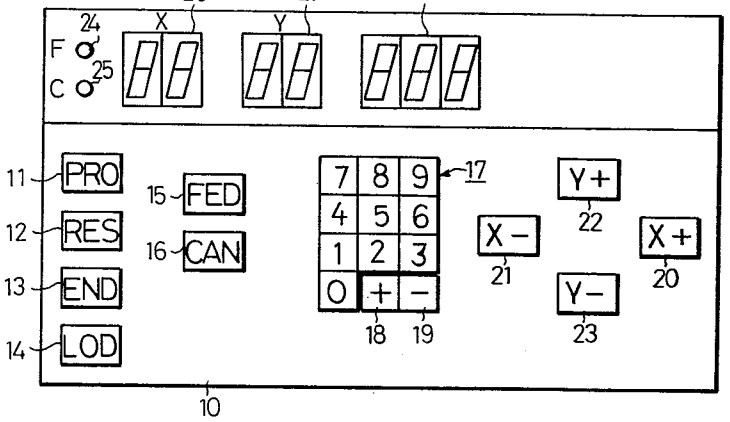
FIG. 3 is an enlarged front view showing the keyboard and display sections on the programming case.

As shown in FIG. 1, an operating case 9 to be used as a programming means is mounted on the upper surface of said table 1, removed from the sewing machine. The case 9 has a keyboard 10 provided with a multiplicity of operating keys, as shown in FIG. 3, said keys being composed of a function key group consisting of a programming key 11, a reset key 12, an end key 13, a load key 14, a feed key 15 and a cancel key 16, a numerical key group 17 consisting of numerals "0" to "9", a plus key 18, a minus key 19, X-axis jog keys 20 and 21 for moving said work holder 7 in the positive X-axis direction (the direction shown by arrow mark X in FIGS. 2 and 5) and in the opposite or negative X-axis direction, and Y-axis jog keys 22 and 23 for moving the work holder 7 in the positive Y-axis direction (the direction show by arrow mark Y in FIGS. 2 and 5) and in the opposite or negative Y-axis direction.

The case 9 also has a number of display sections or indicators including a feed lamp 24 for display of the operational state of said feed key 15, a cancel lamp 25 for display of the operational state of said cancel key 16, an X-axis display section 26 for display of the shift or displacement in the X-axis direction of the work holder 7 caused by operation of said X-axis jog keys 20 and 21, a Y-axis display section 27 for display of the shift or displacement in the Y-axis direction of the work holder caused by operation of said Y-axis jog keys 22 and 23, and a numerical display 28 for display of three digit figures subject to the operation of the numerical keys of the key group 17, with each digit being a numeral from "0" to "9". Said lamps 24 and 25 consist of light emitting diodes, said X-axis and Y-axis display sections each consist of two 7-segment light emitting diodes and said numerical display section 28 consists of three 7-segment light emitting diodes.

Figure 4:
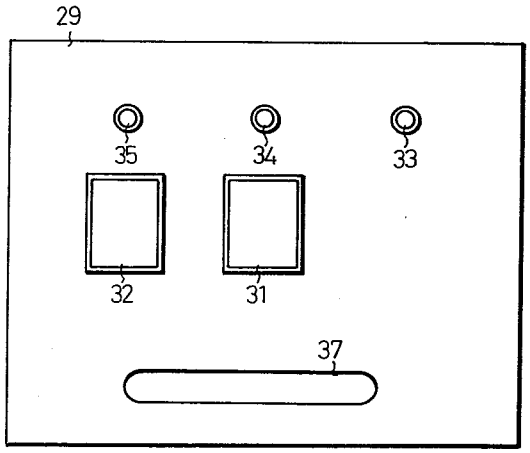
FIG. 4 is an enlarged front view showing the switches and lamps on the control panel.

As shown in FIG. 1, a control panel 29 and a power switch 30 are mounted to the front side of table 1. As shown in FIG. 4, the control panel 29 mounts serves as a mount for a test intermediate sewing switch 31 (hereafter referred to simply as test switch), an emergency stop and return switch 32 (hereafter referred to simply as emergency stop switch), a power lamp 33, a test lamp 34 and an emergency stop lamp 35. The panel also has an opening 37 for insertion of a magnetic card 36 shown in FIG. 20. Said test switch 31 is arranged as a hold type switch that is held in the operative position by a depressing operation and returned to a release position by the following depressing operation. A start pedal 38 for start of sewing and a lamp pedal 39 are provided below table 1.

Figure 5:
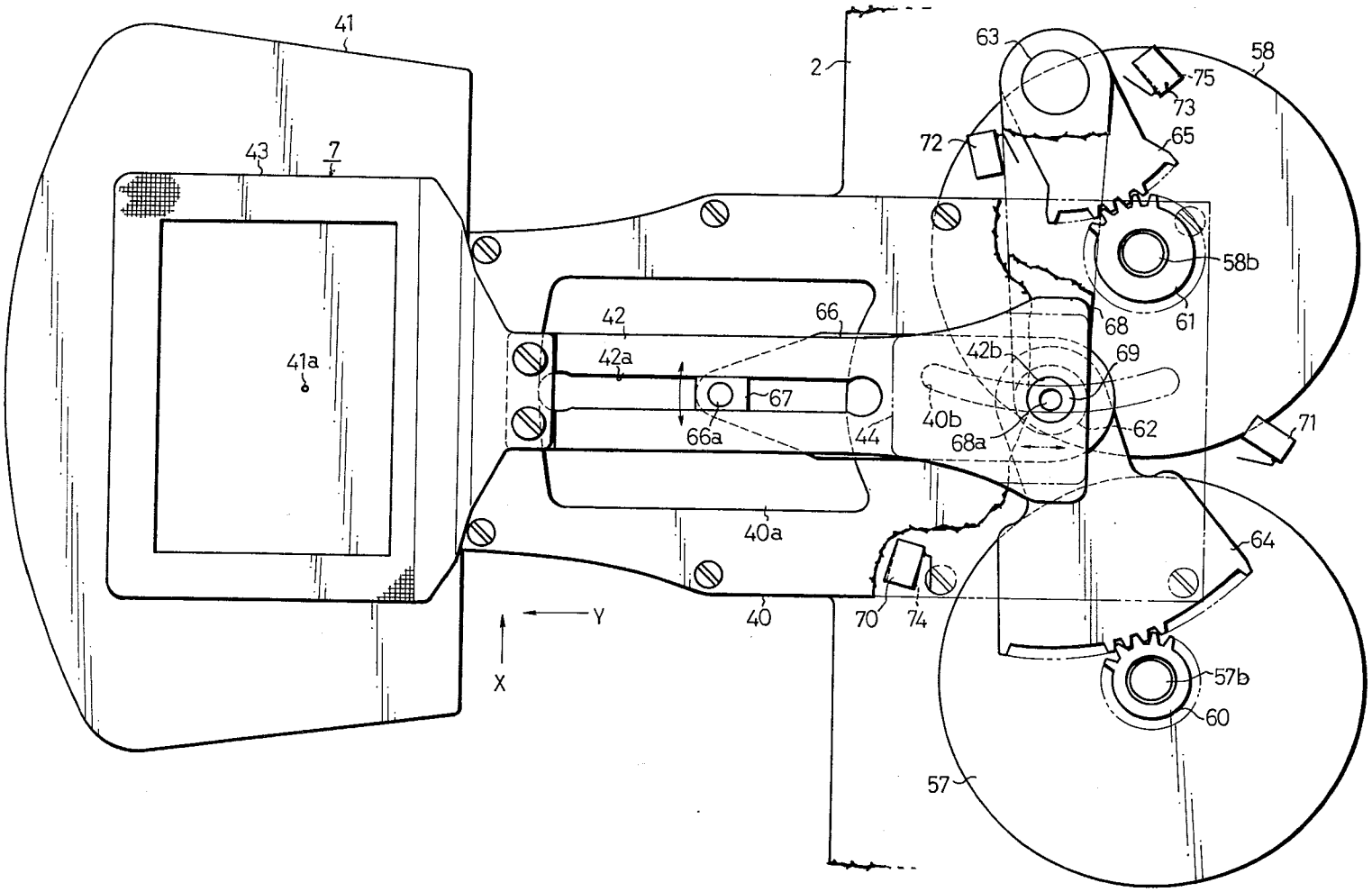
FIG. 5 is an enlarged plan view showing the work holder and feed drive means therefor.

Referring to FIGS. 2 and 5 for illustrating the construction of the work holder 7, a cover plate 40 and a needle plate 41 are secured to the work supporting bed 2*c* of frame 2. Said cover plate 40 has a slot 40*a* and an arcuate elongated slot 40*b*, while the needle plate 41 has a needle aperture 41*a*. A feed bar 42 is movably carried on the cover plate 40 and has an engaging groove 42*a* in register with said slot 40*a* and an engaging slot 42*b* in register with said elongated slot 40*b*. A feed plate 43 in the form of a rectangular frame is secured to the front end of the feed bar 42 for movement on the needle plate 41 as one with the feed bar 42. A supporting arm 44 is secured to said feed bar 42 and extends forwardly between the bed 2c and the bracket arm 2b of frame 2.

A pair of movable plates 45 are supported for vertical movement by the front part of the supporting arm 44. To the lower end of each of said movable plates 45, a work presser plate 46 substantially in the form of a letter U when seen in plan view is secured for clampingly holding the work fabric 8 between it and feed plate 43, as shown in FIGS. 8 and 9. A pair of operating levers 48 are supported rotatably by a supporting axis 47 on both sides of the supporting arm 44 for engaging at the respective front end portions with said movable plates 45. Each tension spring 49 is placed between said operating lever 48 and the arm 44 for urging said work presser plate 46 downwards with a weak spring pressure. A pair of presser levers 50 are rotatably supported on both sides of supporting arm 44 by said axis 47 for engaging with said operating levers 48 at the extreme engaging portions 50a. Each presser spring 51 is torsionally mounted between each said lever 50 and supporting arm 44 for applying a work fabric holding pressure to the work presser plate 46 by way of operating lever 48 and movable plate 45.

A release plate 52 for releasing the holding pressure is carried vertically movably on the lower surface of the bracket arm 2b of the sewing machine frame 2 for engagement with the rear end of the presser lever 50. Thus, during halting of the sewing machine, as release plate 52 is lowered by operation of the power drive mechanism, to be described later, the presser levers 50 are rotated clockwise in FIG. 2 against the action of presser spring 51 so that the engaging portions 50a are disengaged from operating lever 48 to release the holding pressure of the presser springs 51 on the work presser plate 46. On the other hand, during starting of the sewing machine, as the release plate 52 is raised by the power drive mechanism, the presser levers 50 are rotated in the reverse direction under the force of the presser springs 51 so that the engaging portions 50a are engaged with the operating lever 48 for applying the holding pressure of the presser springs 51 to the work presser plates 46.

Figure 6:
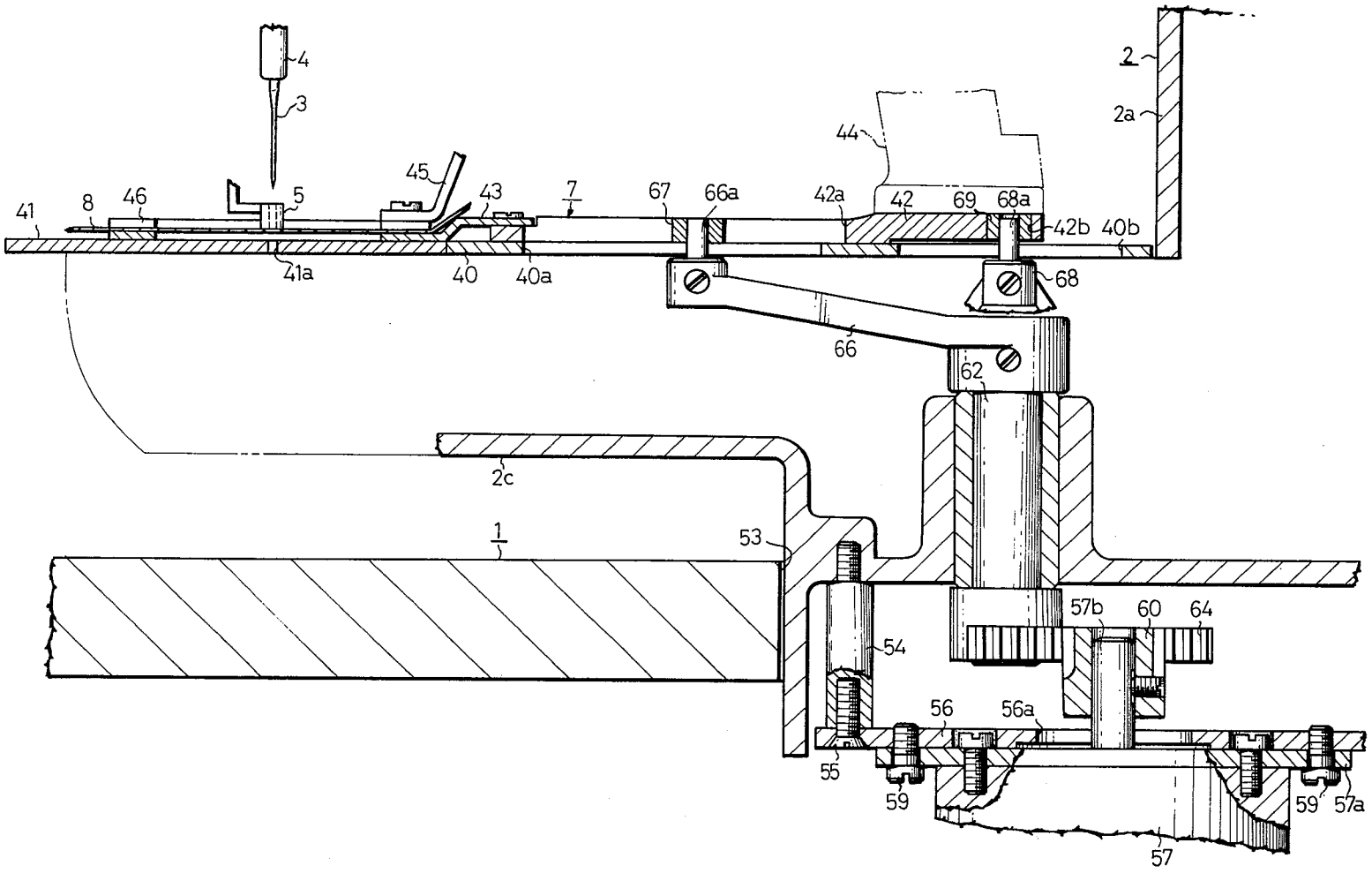
FIG. 6 is a side elevation in longitudinal section showing essential parts shown in FIG. 5.
Figure 7:
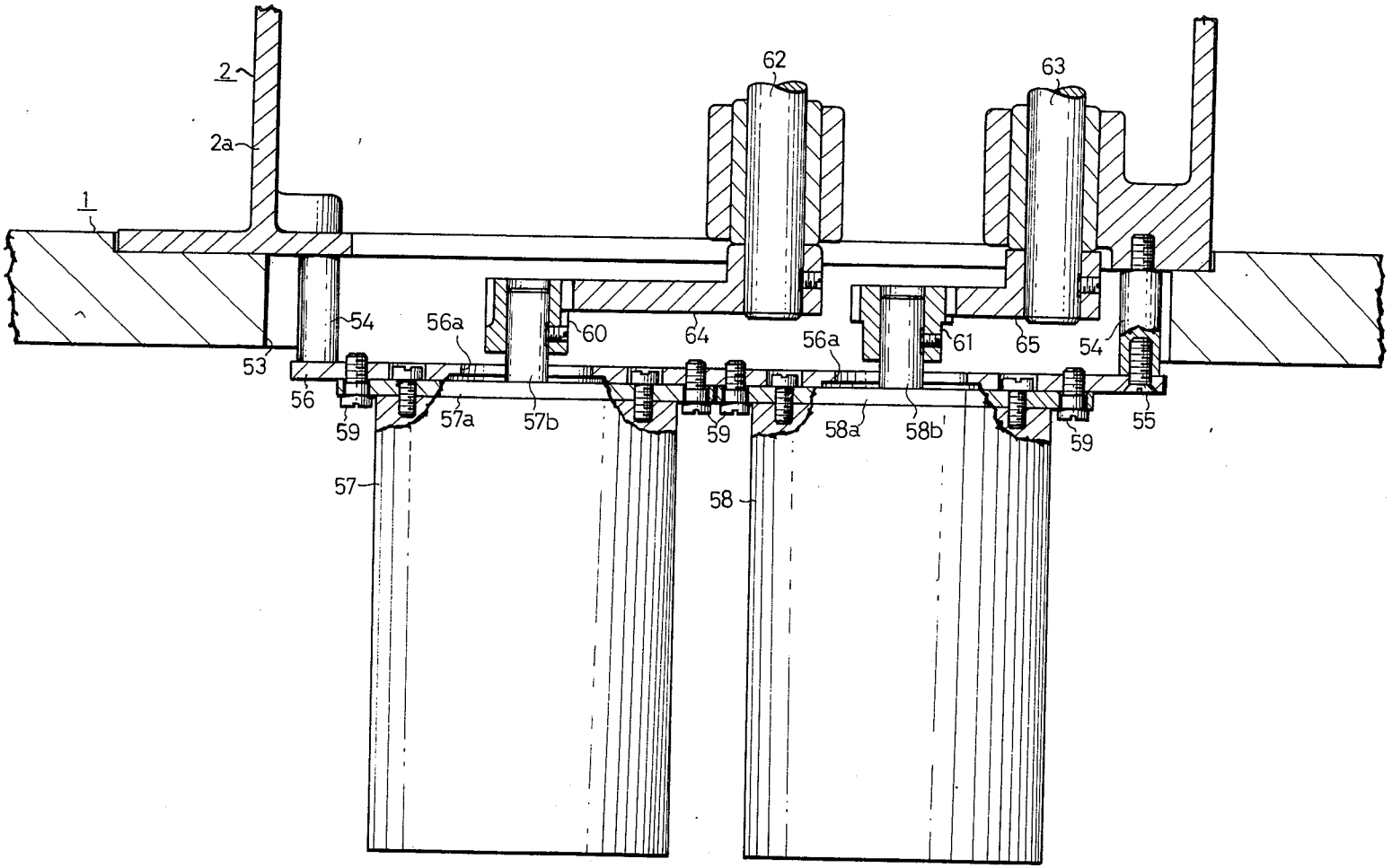
FIG. 7 is a rear view in longitudinal section showing essential parts shown in FIG. 5.

Referring to FIGS. 2, 5, 6 and 7 for illustrating the construction of a feed drive means for displacing said work holder 7, a plurality of supporting members 54 are projectingly mounted to the lower surface of the standard 2a of the sewing machine frame 2 for extending downwards through slots 53 in table 1, as shown in FIGS. 6 and 7. A plate 56 is secured by screws 55 to the lower end faces of these supporting members 54. An X-axis pulse motor 57 and a Y-axis pulse motor 58 are suspendedly secured in vicinity of upper flange portions 57a and 58a to the lower surface of plate 56 with screws 59. Drive gears 60 and 61 are mounted respectively to motor shafts 57b and 58b extending upwards from these motors 57 and 58 through slots 56a in the plate 56. In the present embodiment, these motors 57 and 58 are mounted substantially in register with the center of gravity of the frame 2 including various sewing machine components. Thus, in the above construction, pulse motors 57 and 58 can be easily mounted to the frame 2. Moreover, in distinction from sewing machines wherein heavy pulse motors are mounted at a higher location than the center of gravity of the frame, excess vibrations of the frame 2 can be positively precluded during operation of the sewing machine.

As shown in FIGS. 5, 6 and 7, rotary shafts 62 and 63 are rotatably mounted within frame 2 in registry with X-axis and Y-axis pulse motors 57 and 58. Segmental driven gears 64 and 65 are secured to the lower ends of these rotary shafts for meshing with said drive gears 60 and 61. An X-axis operating arm 66 is mounted to the upper extremity of the rotary shaft and has a projecting end pin 66a extending upwards through slot 40a of said cover plate 40. A slide block 67 is accommodated slidably in the engaging slot 42a of the feed bar 42, and the pin 66a is fitted centrally into slide block 67. A Y-axis operating arm 68 is mounted to the upper extremity of the other arm 63 and has a projecting end pin 68a extending upwards through elongated slot 40b of the cover plate 40. Said end pin 68a is carried by a bearing member 69 fitted into the engaging slot 42b of the feed bar 42. Thus, upon stepwise rotation of the X-axis pulse motor 57, the work holder 7 is displaced as a whole in the X-axis direction through the drive gear 60, the driven gear 64, the rotary shaft 62 and the X-axis operating arm 66. On the other hand, upon stepwise rotation of the Y-axis pulse motor 58, the work holder 7 is moved as a whole in the Y-axis direction through the drive gear 61, the driven gear 65, the rotary shaft 63 and the Y-axis operating arm 68.

In the above arrangement, work holder 7 is displaced by rotation of the X-axis and Y-axis operating arms 66 and 68, so that the work holder 7 is not moved linearly in the X-axis and Y-axis directions. However, in the present specification, such displacement will be designated simply as X-axis and Y-axis displacement for the sake of clarity.

As shown in FIG. 5, positive and negative X-axis direction limit switches 70 and 71 are provided in the frame 2 on either sides of the one driven gear 64 for actuation by both side edges of the driven gear 64 for regulating the extent of travel of the work holder 7 in the X-axis direction. Positive and negative Y-axis direction limit switches 72 and 73 are mounted in the frame 2 on either sides of the other driven gear 65 for actuation by both side edges of the driven gear 65 for regulating the extent of travel of the work holder 7 in the Y-axis direction. Below said positive X-axis limit switch 70 and negative Y-axis limit switch 73, limit switches 74 and 75 are mounted for indicating X-axis start point and Y-axis start point and are actuated by one side edge of the driven gears 64 and 65 for indicating absolute home position of the work holder 7.

Figure 10:
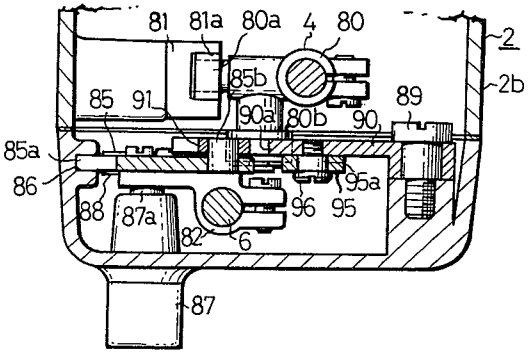
FIG. 10 is a sectional view taken along line 10—10 of FIG. 8.

Referring to FIGS. 2, 8, 9 and 10 for illustration of the arrangement for raising and lowering the needle bar 4 and the presser bar 6, a main shaft 76 is rotatably mounted in bracket arm 2b of the frame 2, as shown in FIG. 2, and a crank member 77 is mounted to the front extremity of the main shaft 76. With rotation of the main shaft 76, the needle bar 4 is moved vertically by the crank member 77 through the medium of a crank rod 78, at the same time that a take-up lever 79 mounted to the upper portion of the bracket arm 2b is urged into a swinging movement. A needle bar holder 80 is secured on said needle bar 4. As shown in FIGS. 8 to 10, a slide block 80a is secured on needle bar 4 laterally of the needle bar holder, while a roller 80b is rotatably mounted ahead of the needle bar holder. A guide plate 81 having a vertically extending guide groove 81a is mounted within said bracket arm 2b for engagement by said slide block 80a to guide the vertical travel of the needle bar 4.

A presser bar holder 82 is secured to the presser bar 6. A presser spring 84 is interposed between the holder 82 and an adjusting screw 83 threadedly mounted to the bracket arm 2b for downwardly pressing the presser bar 6 for applying a holding pressure to the presser foot 5. An operating plate 85 is secured to the presser bar holder 82 and is formed with a boss 85a and an upper end pin 85b, said boss 85a engaging with guide groove 86 of bracket arm 2b for guiding the vertical movement of presser bar 6. A lifting lever 87 is rotatably mounted to the front surface of bracket arm 2b, and a cam 88 is secured to the inner extremity of a rotary shaft 87a for engaging with the lower surface of said operating plate 85.

Thus, upon clockwise rotation of the lifting lever 87 from the position shown in FIG. 8, the operating plate 85, presser bar holder 82 and presser bar 6 are raised by the action of the cam 88 as one unit, against the action of presser spring 84, for disengaging the presser foot from the work fabric 8.

A rotating lever 90 is mounted inside the bracket arm 2b by a stepped screw 89 and has at an end a bifurcate portion 90a. A slide block 91 is slidably accommodated in the bifurcate portion 90a and has the pin 85b of said operating plate 85 fitted into its central opening so that said plate 85 may be moved vertically with rotation of said rotating lever 90. A cam plate 92 is projectingly mounted to the lower portion of the rotating lever 90, and a low cam portion 92a engaging with front roller 80b on the needle bar holder 80, an inclined cam portion 92b, and an elevated cam portion 92c, are formed consecutively on one side of the cam plate 92. Thus, when the needle bar 4 is raised from the FIG. 8 position, the front roller 80b will travel from the cam portion 92a of the cam plate 92 to the elevated cam portion 92c through inclined cam portion 92b so that the rotating lever 90 is rotated clockwise and the presser bar 6 is raised slightly later than the needle bar 4 through operating lever 85 and presser bar holder 82. As the needle bar 4 is lowered, the roller 80b will travel from the elevated cam portion 92c to low cam portion 92a through inclined cam portion 92b so that rotating lever 90 is rotated counterclockwise and presser bar 6 is lowered slightly later than the needle bar 4.

As shown in FIGS. 8 and 9, a flexible cable 94 is mounted at one end to the bracket arm 2b of the sewing machine frame 2 by securing means 93 and the core wire end of the cable 94 is secured to said rotating lever 90 by a stepped screw 96 through securing means 95 having an elongated slot 95a. The flexible cable 94 is extended from bracket arm 2b into the inside of table 1 externally of sewing machine frame 2, as shown in FIG. 1, and the other core wire end is connected to an actuating member, not shown, that is driven by a D.C. motor 97 of FIG. 20.

Figure 11:
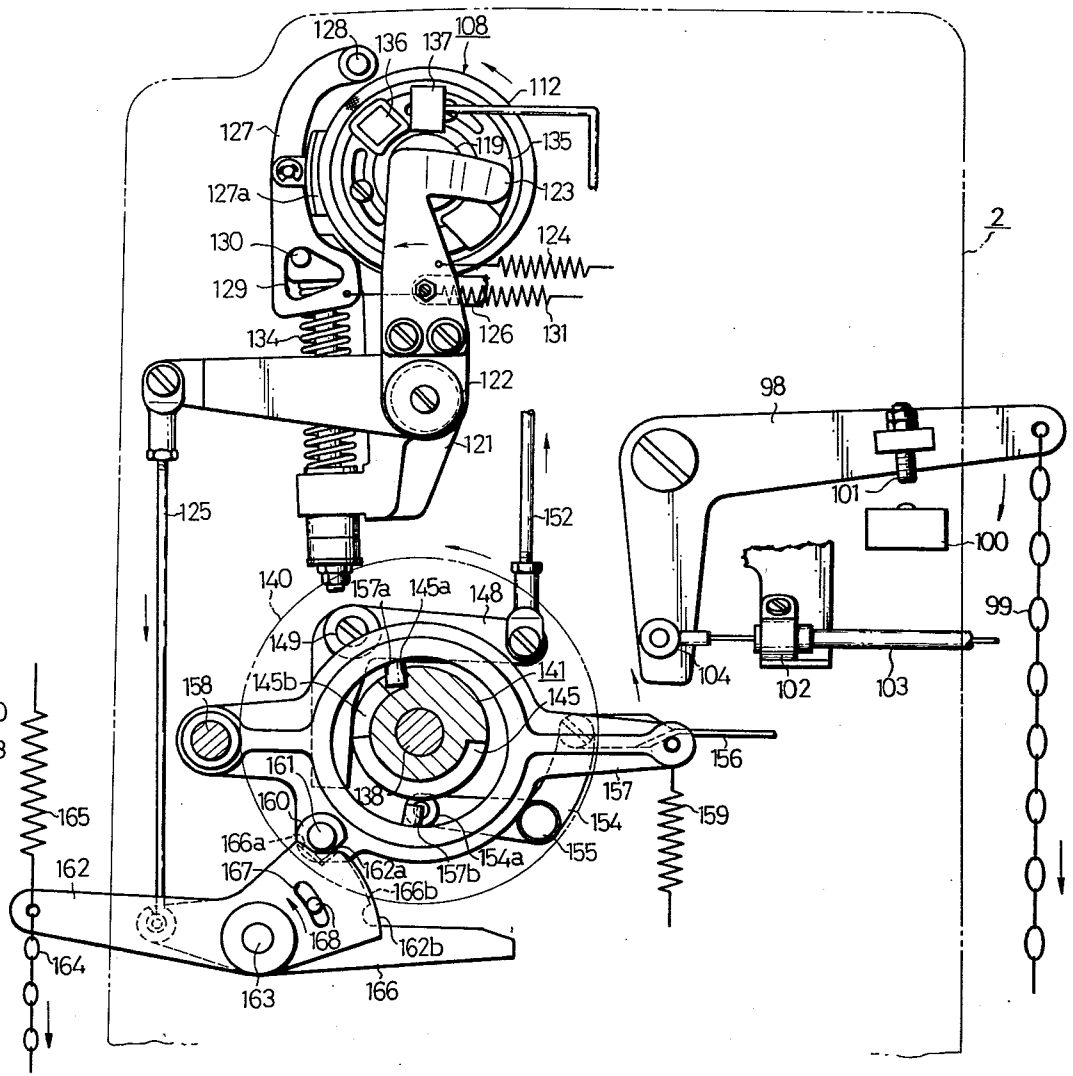
FIG. 11 is an enlarged rear view showing the motion control mechanism and power drive mechanism or power unit shown in FIG. 2.

As shown in FIG. 11, a releasing lever 98 is mounted within the frame 2 of the sewing machine and has one end connected by chain 99 to clamp pedal 39 of FIG. 1. A microswitch 100 is mounted near the releasing lever 98 and designed to be closed by a screw 101 on the releasing lever 98 to start the motor 97, when said clamp pedal 39 is pressed during standstill of the sewing machine and the releasing lever 98 is rotated clockwise in FIG. 11. Thus, with start of this D.C. motor 97, the rotating lever 90 is rotated clockwise by said flexible cable 94 from the position of FIG. 8 and the presser bar 6 is elevated to disengage the presser foot 5 from work fabric 8, in the same way as during operation of the lifting lever 87.

As shown in FIG. 11, a flexible cable 103 is mounted at one end internally of the sewing machine frame 2, by securing means 102, and the core wire end of the cable is secured to the other end of the releasing lever 98 through securing means 104. The cable 103 is connected to the operating lever 48 in the work holder 7 shown in FIG. 2 in such a manner that, when the releasing lever 98 has been rotated clockwise in FIG. 1 by application foot pressure to said crank pedal 39, the operating lever 48 is rotated by the medium of flexible cable 103 to lift the pressure foot 46, provided that the pressure of the presser spring 51 on the presser bar 46 has been released as discussed in the foregoing. Thus, with the presser bar 46 thus lifted, the work fabric 8 may be readily removed from the space defined between the feed plate 43 and the work pressing plate 46.

Referring to FIGS. 2, 11, 12 and 13 for illustrating the details of the drive means for driving the main shaft 76 and of a motion control mechanism for starting and stopping the main shaft 76, a motor 105 is mounted on said table 1 as main shaft drive means, and a pulley 106 of lesser diameter and a pulley 107 of larger diameter are mounted to motor shaft 105a. The motion control mechanism 108 is mounted to the rear end extremity of main shaft 76 and operatively connected to the lesser and larger diameter pulleys 106 and 107 by the medium of a low speed belt 109 and a high speed belt 110 respectively for controlling the start and stop of main shaft 76 originating from operation of said motor 105.

Figure 12:
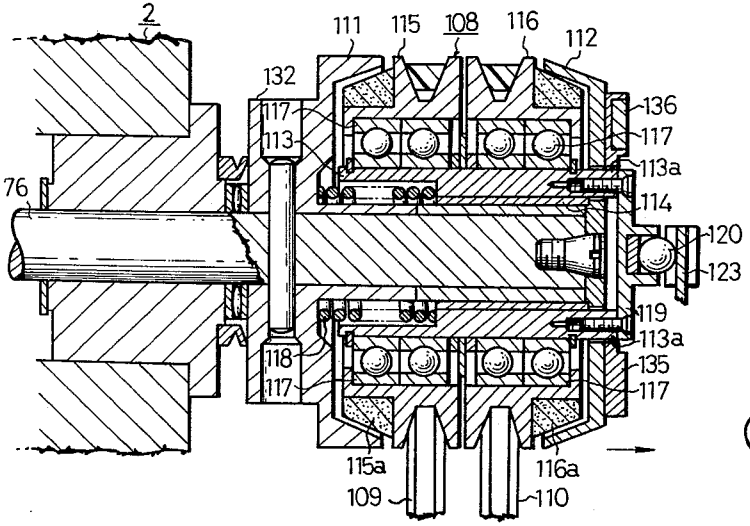
FIG. 12 is an enlarged longitudinal section showing the motion control mechanism of FIG. 11.

Referring to this motion control mechanism 108, a pair of clutch plates 111 and 112 are secured to main shaft 76 at a fixed interval therebetween, as shown in FIG. 12. A slide sleeve 113 is slidably mounted by a bearing 114 on the main shaft 76 intermediate said clutch plates 111 and 112. The rear end of the sleeve 113 is formed with plural projections 113a passing through openings in the rear clutch plate 112 so that said main shaft 76, clutch plates 111, 112 and the sleeve 113 may be rotated in unison. On said slide sleeve 113, there are mounted a pair of pulleys 115 and 116 by a bearing 117, and friction members 115a and 116a are secured to these pulleys in register with said clutch plates 111 and 112. Transmission belts 119 and 110 are placed about pulleys 115 and 116 so that, upon rotation of the motor 105, the pulleys 115 and 116 are rotated at low and high speeds, respectively. A compression spring 118 is placed between the clutch plate 111 and the slide sleeve 113 for urging the sleeve 113 towards the rear or rightwards in FIG. 12.

Figure 13:
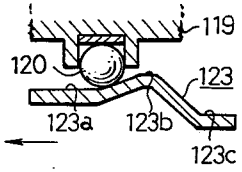
FIG. 13 is a partial sectional view showing cam plate and steel ball device in the motion control mechanism.

A supporting member 119 is mounted to a boss 113a of a slide sleeve 113 and has a recess on its rear surface for rollingly holding a steel ball 120. As shown in FIGS. 2 and 11, an operating member 121 is mounted within the sewing machine frame 2 for rotation about a supporting axis 122. As shown in FIG. 13, a cam plate 123 is mounted to the end part of the operating member 121 and has consecutive stop, low speed and high speed cam surfaces 123a, 123b and 123c for engaging with said steel ball 120. As shown in FIG. 11, a tension spring 124 is placed between cam plate 123 and frame 2 for urging the operating member 121 to rotate clockwise and normally holding the stop cam surface 123a of cam plate 123 engaged with the steel ball 120. The operating member 121 is operatively connected to start pedal 38 shown in FIG. 1 through an operating rod 125 and the power drive mechanism to be described and is further operatively connected through a rod 126 to cam means also to be described.

Thus, when the operating member 121 is rotated counterclockwise in FIG. 11 through operating rod 125 as a result of foot pressure applied to the start pedal 38, the low speed cam surface 123*b* of the cam plate 123 is moved into engagement with steel ball 120. Thus the sleeve 113 slides in a direction opposite to that shown by the arrow mark in FIG. 12, against the action of spring 118, so that the friction member 115*a* of pulley 115 is engaged with forward side clutch plate 111 to start the main shaft 76 at low speed. The member 121 is further rotated by the operation of the cam means so that the high speed cam surface 123*c* of cam plate 123 is now moved into engagement with the steel ball 120. The sleeve 113 thus slides in the arrow mark direction in FIG. 12 under the action of spring 118 for engaging the friction member 116*a* of pulley 116 with the rear side clutch plate 112 to effect high speed rotation of main shaft 76. Since the operating member 121 is held in the lastly stated rotational position through the rod 126 and by virtue of the cam means, as will be described later, until completion of one sewing cycle, revolution of main shaft 76 does not cease even if the foot pressure on start pedal 38 should be released. Upon completion of one sewing cycle, the member 121 is rotationally returned by operation of said cam means and under the action of tension spring 124, the main shaft 76 shifting from the state of high speed revolution to a standstill through the state of low speed revolution.

As shown in FIG. 11, a brake member 127 is rotatably supported in the frame 2 by a supporting axis 128 and fitted with a brake shoe 127*a* in register with outer periphery of forward side clutch plate 111. The brake member 127 has a cam slot 129 for engagement by a pin 130 projectingly mounted to the operating member 121, a tension spring 131 is placed between the brake member 127 and the frame 2 for urging the brake member 127 to rotate counterclockwise in FIG. 11 for normally abutting the brake shoe 127*a* on the outer periphery of the forward side clutch plate 111.

Thus, when the operating member 121 has started to rotate counterclockwise in FIG. 11, as a result of foot pressure application to start pedal 38, the brake member 127 is rotated slightly clockwise by the operation of cam slot 129 to disengage the brake shoe 127*a* from the clutch plate 111. Upon subsequent rotation of operating member 121, the brake member 127 is held in the above stated rotational position due to lost motion produced between the operating member 121 and the brake member 127 and regardless of such further rotation of the operating member 121. At the completion of the sewing operation, when the member 121 has been rotationally returned under the action of tension spring 124, the brake member 127 is rotationally returned under the action of tension spring 131, the brake shoe 127*a* then abutting pressedly on the peripheral surface of the clutch plate 111 for braking the main shaft 76 to a halt.

As shown in FIG. 2, a stop cam 132 is projectedly mounted on the front surface of the forward side clutch plate 111 on the main shaft 76 and has a peripheral notch 132*a*. In register with said cam 132, a stopper member 133 is carried vertically movably on the operating member 121, and is urged upwards by a compression spring 134. Thus, upon rotation of the operating member 121 as a result of foot pressure application on the start pedal 38, stopper member 133 is receded out of rotational extent of cam 132 to permit revolution of main shaft 76. When the operating member 121 has been rotationally returned at the completion of the sewing operation, the stopper member 133 is engaged with the peripheral surface of stop cam 132, with the pulleys 115 and 116 being disengaged from clutch plates 111 and 112 and the main shaft 76 making a low speed revolution. Subsequently, the main shaft 76 is stopped at a predetermined position by engagement of the stopper member 133 and the notch 132*a* for halting the needle 3 (FIG. 2) in the vicinity of the upper dead point above the needle plate 41.

As shown in FIGS. 11, 12, a permanent magnet 136 is mounted by plate 135 to the back surface of the rear side clutch plate 112. In register with said permanent magnet 136, a Hall element 137 is mounted as a timing signal generator in the frame 2 so that, when the needle 3 has moved slightly above the needle slot 41*a* in the needle plate 41 during the sewing operation by rotation of the main shaft 76, the element 137 is confronted by said magnet 136 to produce a timing signal timed to the revolution of the main shaft 76.

Reference is made to FIGS. 2, 11, 14, 15 and 16 for illustrating the details of the power drive mechanism or power unit for applying or releasing the pressure of the presser spring 51 to the work pressure plate 46 of the work holder 7 in connection with the start and stop of main shaft 76 effected by the motion control mechanism 108.

Figure 14:
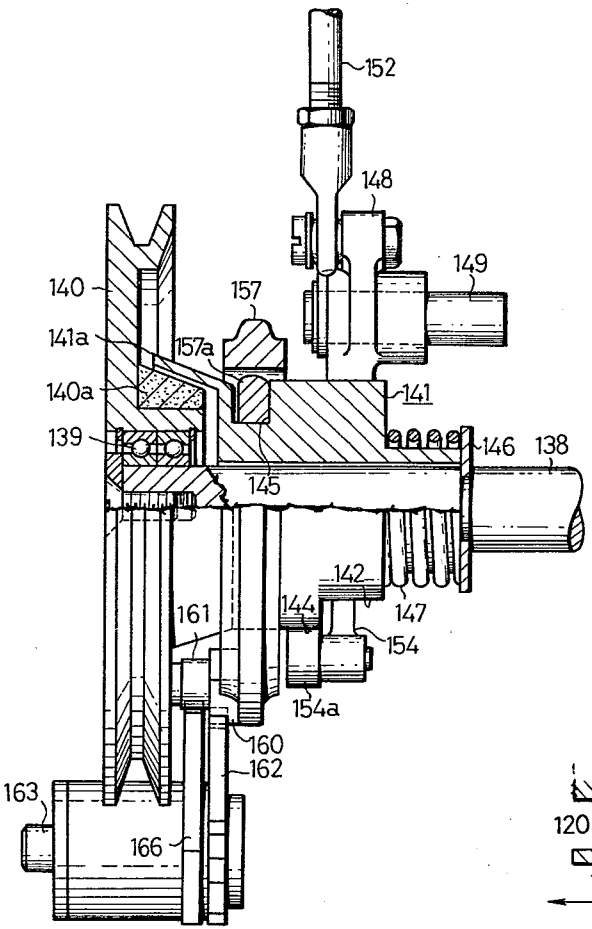
FIG. 14 is an enlarged sectional view in longitudinal section showing the power drive mechanism or power unit shown in FIG. 11.

A stationary supporting axis 138 is mounted within the frame 2 and below said motion control mechanism 108. As shown in FIG. 14, a pulley 140 is mounted by way of a bearing 139 on the supporting axis 138 and fitted on its forward side with a friction member 140*a*. On said pulley 140 is placed the low speed belt 109, as shown in FIG. 2, to effect the low speed rotation in the arrow mark direction in FIG. 2 with revolution of the motor 105. A cam member 141 is rotatably and translatably mounted on the supporting axis 138 and fitted on the rear surface with a friction plate 141*a* for engagement with or disengagement from friction member 140*a*. As shown in FIGS. 2, 11 and 14, the outer periphery of the cam member 141 is formed with a first peripheral cam 142 for controlling the application and release of work fabric holding pressure, a second peripheral cam 144 for controlling the operation of a thread cutting mechanism 143 mounted in the work supporting bed 2*c* of the frame 2, and a groove cam 145 for controlling the rotation of the operating member 121 of the motion control mechanism 108. A compression spring 147 is placed between the forward side of the cam member 141 and a member 146 on supporting axis 138 for urging the cam member 141 towards the pulley 140 for normally engaging said clutch plate 141*a* with the friction member 140*a*.

A bifurcate lever 148 is mounted above the cam member 141 within the frame 2 for swinging about supporting axis 149 and engaged at one end with the first peripheral cam 142 so as to be swung by cam operation. The other end of the lever 148 is connected to the release plate 52 through two rods 152, 153 and two bifurcated levers 150 and 151 mounted within the frame 2, for raising or lowering the release plate with the swinging of lever 148. A bifurcated operating lever 154 is supported below said cam member 141 within the frame 2 for swinging about a supporting axis 155. As shown in FIGS. 2 and 14, the lever 154 is fitted at one end with a roller 154*a* engaging with or disengaging from the second peripheral cam 144, and also fitted at the other end with a rod 156 extending to the above stated cam means.

Figure 15:
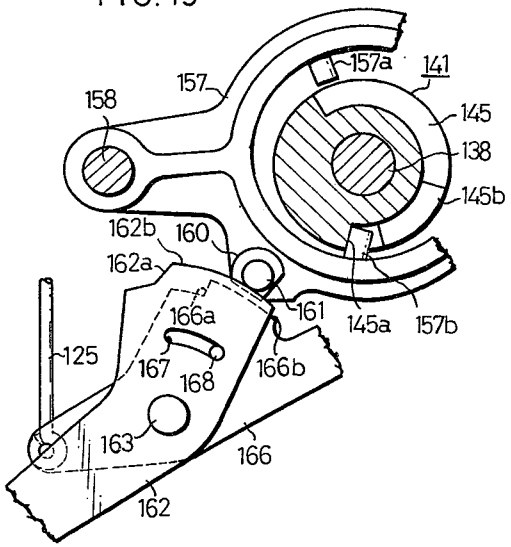
FIGS. 15 and 16 are partial sectional views showing the operating states of the power drive mechanism shown in FIG. 11.

As shown in FIGS. 11 and 15, the groove cam 145 is provided for substantially half circumference of the cam member 141, and is formed with an end stopper portion 145*a* and an inclined lateral cam portion 145*b*. In register with said groove cam 145, an annular rotary lever 157 is mounted within the frame 2 for rotating or swinging about a supporting axis 158. A pair of projecting pins 157*a* and 157*b* are mounted in confronting relation on the inner periphery of lever 157 for alternately engaging with said groove cam 145. A tension spring 159 is mounted between the rotary lever 157 and frame 2 for urging the lever 157 to rotate counterclockwise in FIG. 11. A projection 160 is mounted to the lower part of the rotary lever 157. On an end extremity of said projection 160 is rotatably mounted an end roller 161.

As shown in FIGS. 2 and 11, a first operating lever 162 is mounted below said rotary lever 157 within frame 2 for swinging about a supporting axis 163. Said lever 162 has at one end an inclined surface 162*a* and an arcuate surface 162*b* for engaging with roller 161, being connected by chain 164 to start pedal 38 (FIG. 1) at the other end. A tension spring 165 is mounted between the lever 162 and the frame 2 for urging said lever 162 to rotate clockwise in FIG. 11 so as to normally maintain the start pedal 38 in its elevated position.

A second operating lever 166 is mounted on said supporting axis 163 ahead of said first operating lever 162 and has at one end an engaging portion 166*a* and an arcuate portion 166*b* for engaging with projection 160 on the rotary lever 157. The lever 166 is connected at the other end to the lower extremity of the operating rod 125 extending from the operating member 121 of the motion control mechanism 108. Said first operating lever 162 has an arcuate elongated slot 167 for engagement by a pin 168 formed on the second operating lever 166. Through cooperation between slot 167 and pin 168, the two levers 162 and 166 may be connected to each other following relative rotation within a certain angle.

With the above power unit, prior to pressure application to start pedal 38, as shown in FIG. 11, the inclined surface 162*a* of the first operating lever 162 is engaged with roller 161 and the engaging portion 166*a* of second operating lever 166 is engaged with the projection 160 to hold the rotary lever 157 in the position shown in FIG. 11, while the pin 157*a* engages with stopper portion 145*a* of groove cam 145 to hold the cam camber 141 in the position shown in FIG. 14 wherein its clutch plate 141*a* is disengaged from friction member 140*a* of the pulley 140.

In such state, since the operating rod 125 connected to second operating lever 166 is urged upwards, the operating member 121 of the motion control mechanism 108 is kept in the original position shown in FIG. 11, the main shaft 76 being at a standstill. Since the lever 148 is held in the rotational position shown in FIG. 11, by operation of the first peripheral cam 142 on the cam member 141, the rod 152 being thus urged downwards, the release plate 52 is kept in the lowered position through levers 150, 151 and rod 153 (FIG. 2) and the two presser levers 50 have been rotated against the action of the presser spring 51, the work holding pressure of the pressure spring 51 on the two work pressing plates 46 being thus released.

Upon depressing start pedal 38 in this state, the first operating lever 162 is turned counterclockwise in FIG. 1 through a chain 164, but the rotary force is not transmitted at this time due to lost motion to the second operating lever end part of the elongated slot 167 in the lever 166, until the pin 168 on the second operating lever 166 engages with the end of the elongated slot 167 on the first operating lever 162, the main shaft 76 being still halted.

With continued rotation of the first operating lever 162, the roller 161 rides on the arcuate surface 162*b* away from the inclined surface 162*a* of the lever 162 so that the rotary lever 157 is turned counterclockwise from the state of FIG. 11, thus one pin 157*a* disengaging from the groove cam 145 and the other pin 157*b* intruding into groove cam 145. Thus, the cam member 141 is moved towards the side of pulley 140 (FIG. 14) by operation of compressed spring 147, the clutch plate 141*a* engaging with the friction member 140*a* and the cam member 141 rotating counterclockwise at low speed from the state of FIG. 11. With such rotation, said other pin 157*b* engages with the inclined cam portion 145*b* of the groove cam 145, and the cam member 141 is shifted away from pulley 140, against the action of the spring 147. Thus, when the other pin 157*b* engages with stopper portion 145*a* of the groove cam 145, the clutch plate 141*a* is disengaged from the friction member 140*a*, the cam member 141 being halted after about half revolution.

With such half revolution of the cam member 141, the lever 148 is turned counterclockwise from the state of FIG. 11, by operation of the first peripheral cam 142, the release plate 52 being raised through the rods 152 and 153 and bifurcated levers 150 and 151. Thus, the two presser levers 50 are rotationally returned, by the action of the presser springs 51, the holding pressure of presser spring 51 being applied to the two presser plates 52 prior to start of main shaft 76. Immediately before such start of main shaft 76, the roller 154*a* of the operating lever 154 is kept in engagement with the second peripheral cam 144 on the cam member 141, by the operation of the cam means, as shown in FIG. 2. In this state, the cam member 141 makes about one half revolution as described above. Cam profile of the second peripheral cam 144 is so selected that the operating lever 154 is not turned during such half revolution and thus the thread cutting mechanism 143 is at a standstill.

Upon further depression of the start pedal 38, the end part of the elongated slot 167 in the lever 162 engages with the pin 168 on the lever 166 so that the levers 162 and 166 are turned in unison counterclockwise as shown in FIG. 15. Thus, the operating rod 125 is pulled down and the operating member 121 of the motion control mechanism 108 (FIG. 1) is rotated counterclockwise for starting the main shaft 76 as described above. Thereafter, operation of motion control mechanism 108 is controlled through the rod 126 by the cam means to be described later, and the member 121 will keep the main shaft 76 in controlled rotation until the end of one sewing cycle, so that the second operating lever 166 is not rotationally returned from the state shown in FIG. 15. Thus, upon release of pressure to the start pedal 38 after the start of the main shaft 76, only the first operating lever 162 will be rotationally returned under the action of the tension spring 165 and within the range of relative rotation between the pin 168 and the slot 167, the second operating lever 166 being in the state of engaging with projection 160 with its arcuate surface 166*b*. Thus, upon release of foot pressure on the start pedal 38, the holding pressure of the presser spring 51 on presser plate 46 is not released, nor the main shaft 76 brought to a standstill.

Figure 16:
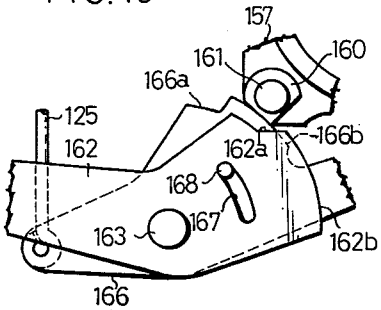

When the operating member 121 of motion control mechanism 108 has been returned rotationally by said cam means, on completion of one sewing cycle operation, only the second operating lever 166 is turned clockwise by the rod 125 from the state of FIG. 16 and projection 160 is disengaged from the arcuate surface 166*b* to engage with portion 166*a*, the rotary lever 157 being rotationally returned to the state of FIG. 11 under the action of tension spring 159. By such rotation, the pin 157*b* is disengaged from the groove cam 145 and the pin 157*a* again intruded into the groove cam 145. The cam 141 is connected to the pulley 140 to effect about one half revolution as at the start of the main shaft 76.

With such half revolution of the cam member 141, the lever 148 is turned clockwise in FIG. 11 under the action of the first peripheral cam 142, and the release plate 52 is lowered through rods 152 and 153 and bifurcated levers 150 and 151 to release the pressure of presser springs 51 on work presser plate 46. In addition, with such half revolution of the cam member 141, the operating lever 154 is turned clockwise in FIG. 11 by operation of the second peripheral cam 144 so that the thread cutting mechanism 143 is actuated through rod 156 to simultaneously cut upper and lower threads connecting to the work fabric 8. This release of pressure and thread cutting occur during low speed revolution of the main shaft 76 while the operating member 121 is being returned. Thereafter, the stopper member 133 of the motion control mechanism 108 engages with recess 132*a* of the cam 132, as shown in FIG. 2, to stop the main shaft 76 at a predetermined position.

Figure 18:
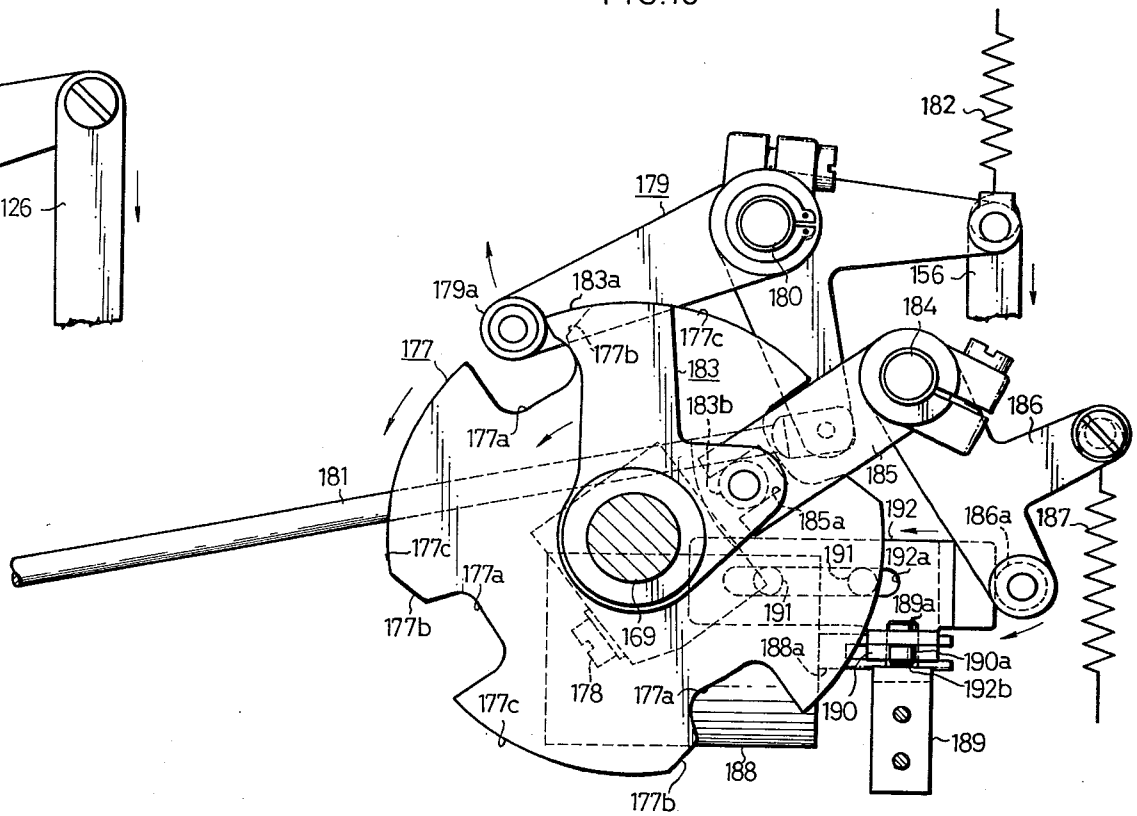
FIG. 18 is an enlarged transverse sectional view showing a second control cam in the cam mechanism and related parts.
Figure 17:
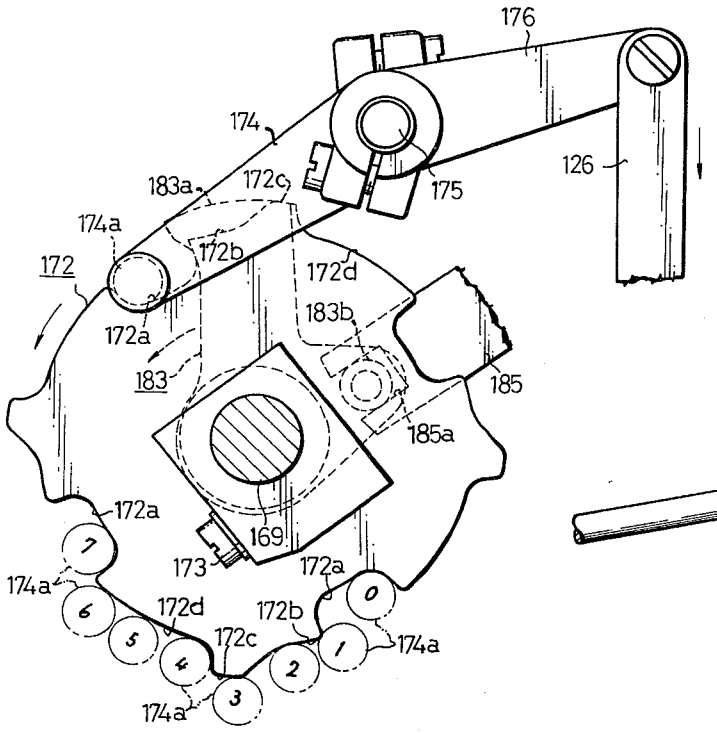
FIG. 17 is an enlarged transverse sectional view showing a first control cam in the cam mechanism and related parts.

Reference is made to FIGS. 2, 17 and 18 for illustrating the cam mechanism or cam means for controlling the operation of motion control mechanism 108 and thread cutting mechanism 143 with a cycle corresponding to the number of plural stitches in relation to revolution of main shaft 76.

As shown in FIG. 2, a cam shaft 169 is rotatably carried within the frame 2 and rotated at reduced speed counterclockwise in FIGS. 17 and 18 through a worm 170 and a worm wheels 171 with revolution of the main shaft 76. A first control cam 172 is secured by a screw 173 to said cam shaft 169 and is formed on its outer periphery with four cam sets of the same profile, with each cam set consisting of a stop cam portion 172*a*, a low speed cam portion 172*b*, a high speed cam portion 172*c* and a low speed cam portion 172*d*. With revolution of the main shaft 76, while the sewing operation is carried out with a cycle corresponding to seven stitches, the first control cam 172 makes a rotation of an angular measure (90°) corresponding to one cam set.

A first follower 174 is rotatably mounted by a rotary shaft 175 within the sewing machine frame 2 laterally of the first control cam 172, and a roller 174*a* is rollingly mounted to the end part of said follower 174 for engaging with the respective cam portions 172*a* to 172*d* of the first control cam 172.

The top of said shaft 175 is secured to a connecting lever 176*a*, to the end of which is connected to the rod 126 extending from the operating member 121 of the motion control mechanism 108. Thus the first follower 174 is urged normally to rotate counterclockwise in FIG. 17, under the action of the tension spring 124 mounted to the operating member 121, for holding the roller 174*a* in engagement with cam portion of control cam 172.

During standstill of the main shaft 76, a roller 174*a* of the follower 174 is positioned, as shown in FIG. 17, in the stop cam portion 172*a* of the first control cam 172. When the operating member 121 of the motion control mechanism 108 is turned counterclockwise from the position of FIG. 11, as a result of depression of start pedal 38, for starting the main shaft 76, the first follower 174 is turned clockwise from the position of FIG. 17, through rod 126 and connecting lever 176, the roller 174*a* disengaging from the stop cam portion 172*a*. After start of the main shaft 76 and with rotation of the first control cam 172 interclocked with the main shaft 76, the roller 174*a* of the said first follower 174 engages with the low speed cam portion 172*b* of the first control cam 172 during sewing operation with first and second stitches, for holding the operating member 121 of the motion control mechanism 108 at low speed position. During sewing operation with third needle, the roller 174*a* engages the high speed cam portion 172*c* for switching the member 121 to high speed position and maintaining the member 121 in such high speed position. During sewing operation with fourth to sixth stitches, the roller 174*a* engages with low speed cam portion 174*d* for switching the operating member 121 to low speed position and maintaining the operating member in such position. During sewing operation with seventh stitch, the roller 174*a* engages with the stop cam portion 172*a* for returning the operating member 121 to a stop position shown in FIG. 11. The operational sequence is suggested by FIGS. 0 to 7 enclosed in circles in FIG. 17.

Below said first control cam 172, a second control cam 177 is secured to the cam shaft 169 with screw 178 and is formed on its outer peripheral surface with four cam sets of the same cam profile, each such set consisting of a low cam portion 177*a*, an inclined cam portion 177*b* and an elevated cam portion 177*c*, as shown in FIG. 18. The low cam portion 177*a* of the second control cam 177 is placed in register with the stop cam portion 172*a* of the first control cam 172 so that, while sewing operation is being effected with a cycle corresponding to seven stitches, with continued revolution of main shaft 76, this second control cam 177 makes a partial rotation for an angular measure of 90° corresponding to one cam set.

A three-armed second follower 179 is mounted within the frame 2 and laterally of said second control cam 177 for rotation about a shaft 180, with its one arm carrying a roller 179*a* engageable with respective cam portions 177*a* to 177*c* of second control cam 177. As shown in FIGS. 2 and 18, the other arm of the second follower is connected to the rod 156 extending from the operating lever 154 of the power unit, while the further arm is connected to a rod 181 extending from the thread cutting mechanism 143 in the work supporting bed 2*c*. A tension spring 182 is mounted between a second follower 179 and the frame 2. By operation of this tension spring 182, the second follower 179 is rotationally urged in a direction to engage the cam portions 177*a* to 177*c* of the second control cam 177 with its roller 179*a*, while the operating lever 154 of the power unit is rotationally urged in a direction to engage the second peripheral cam 144 of the cam member 141.

During standstill of the main shaft 76, as shown in FIG. 18, the roller 179*a* of the second follower 179 is confronted by the low cam portion 177*a* of the second control cam 177 to hold the roller 154*a* of said operating lever 154 engaged with second peripheral cam 144 on cam member 141. Should the main shaft 76 be started from such state, with rotation of the second control cam 177, the roller 179*a* of the second follower 179 is shifted from the low cam portion 177*a* through inclined cam portion 177*b* to ride on the elevated cam portion 177*c* and thus rotated clockwise in FIG. 18, the roller 154*a* of said operating lever 154 disengaging from the second peripheral cam 144 through the rod 156. During sewing operation of the seventh needle 3, the roller 179*a* of the second follower 179 is again confronted by the low cam portion 177*a* of the second control cam 177 to engage the roller 154*a* of operating lever 154 with the second peripheral cam 144. As described above, the thread cutting mechanism 143 is actuated through the rods 156, 181 and the second follower 179, by operation of the second peripheral cam 144 for cutting upper and lower threads connecting to the work fabric 8, prior to halt of the main shaft 76.

Reference is now made to FIGS. 2, 17 and 18 for illustrating the operating means for validating or invalidating the operation of the motion control mechanism 108 and the thread cutting mechanism 143 effected by said first and second control cams 172 and 177.

A supporting member 183 is mounted for relative rotation on the cam shaft 169 between the first and the second control cams 172 and 177. The holder 183 has a support portion 183*a* on one outer surface and a pin 183*b* on the other outer lower surface, said portion 183*a* being at the same height as the high speed cam portion 172*c* of the first control cam 172 and the elevated cam portion 177*c* of the second control cam 177. Should the first and second followers 174, 179 be rotated clockwise in FIGS. 17 and 18 and the support member 183 be rotated counterclockwise, rollers 174*a* and 179*a* of the followers 174 and 179 ride on support portion 183*a* of support member 183 to invalidate the rotation of the followers 174 and 179 following the cam portions 172*a* to 172*d* and 177*a* to 177*d* of the control cams 172 and 177.

A shaft 184 is mounted rotatably within the frame 2 and laterally of cam shaft 169. A rotary lever 185 is secured to the upper end of the shaft 184 and formed with a bifurcated end portions 185*a* for engaging with pin 183*b* of said supporting member 183. An operating arm 186 is secured to the lower end of the shaft 184 and carries an end roller 186*a*. A tension spring 187 is mounted between the other end of the arm 186 and the frame 2 for urging the arm 186 to rotate clockwise in FIG. 18 and for urging the supporting member 183 to rotate counterclockwise through the shaft 184 and the rotary lever 185.

Below said second control cam 177, a solenoid 188 is mounted within the frame 2 and is designed to be energized just prior to stop of the main shaft 76 to attract its armature 188*a*. In the neighborhood of solenoid 188, a plate 190 is rotatably supported by a supporting plate 189 through a pin 189*a*. The plate 190 is connected at the lower part to an armature 188*a* and formed at the upper part with a bifurcated portions 190*a*. To one side of said plate 190, an operating plate 192 is translatably mounted by a pair of guide pins 191 engaging in an elongated slot 192*a*. The operating plate 192 has a pin 192*b* on one side engaging with an engaging portion 190*a* of the plate 190 and may be engaged at the rear end with the roller 186*a* mounted to the operating arm 186.

During a standstill of the main shaft 76, as shown in FIG. 18, one outer end of supporting member 183 is engaged with a roller 179*a* of the second follower 179 and the supporting member 183 is held in the clockwise rotated position against the action of tension spring 187, the rollers 174*a* and 179*a* of the first and second followers 174 and 179 disengaging from the support portion 183*a* of supporting member 183.

Supposing that the main shaft 76 is started from this state through the motion control mechanism 108 as a result of depression of start pedal 38, the first follower 174 is rotated by said mechanism 108 clockwise from the state of FIG. 17, and that first and second control cams 172 and 177 are rotated counterclockwise with rotation of the main shaft 76, the roller 174*a* of the first follower 174 is shifted away from the stop cam portion 172*a* of the first control cam 172 through the low speed cam portion 172*b* to ride on the high speed cam portion 172*c*, whereas the roller 179*a* of the second follower 179 is shifted away from the low cam portion 177*a* of the second control cam 177 through inclined cam portion 177*b* to ride on the elevated cam portion 177*c*.

Simultaneously, the supporting member 183 is rotated counterclockwise from the state of FIGS. 17 and 18 under the action of tension spring 187, the rollers 174*a* and 179*a* of the followers 174 and 179 riding on the support portion 183*a* of the supporting member 183 to invalidate the subsequent rotation of the followers 174 and 179 following the cam portions 172*a* to 172*d* and 177*a* to 177*c* of the control cams 172, 177. Thus the operation of the motion control mechanism 108 and the thread cutting mechanism 143 caused by said first and second control cams 172 and 177 is invalidated, once the main shaft 76 has shifted to its high speed revolution.

During the operation of four stitches prior to completion of one cycle of sewing operation corresponding to the required stitches, the solenoid 188 is energized and the supporting member 183 is rotated clockwise from the aforesaid rotational position to the position shown in FIGS. 17 and 18, through plates 190, 192, arm 186, shaft 184 and rotary lever 185. The rollers 174*a*, 179*a* of the followers 174, 179 are disengaged in this way from the supporting portion 183*a* of the supporting member 183 to engage cam portions of the control cams 172 and 177 for validating the operation of the motion control mechanism 108 and the thread cutting mechanism 143 to be effected by the control cams 172 and 177. Thus, during subsequent rotation of the main shaft 76 corresponding to the following four stitches, the roller 174*a* of the first follower 174 is shifted into the stop cam portion 172*a* from the low speed cam portion 172*d* of the first control cam 172 to cause said mechanism 108 to stop the main shaft 76, whereas the roller 179*a* of the second follower 179 is shifted from the elevated cam portion 177*c* of the second control cam 177 into the low cam portion 177*a* of the second control cam 177 to cause the second peripheral cam 144 (FIG. 2) to actuate the thread cutting mechanism 143 to seize and cut upper and lower threads connecting to the work fabric 8 prior to halting of main shaft 76.

Figure 19:
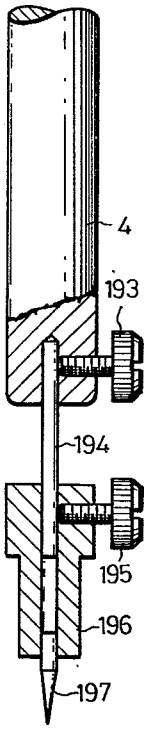
FIG. 19 is an enlarged sectional view showing the mounting of the programming needle to the needle bar.

Reference is made to FIG. 19 for illustrating the composition of a programming needle that is used for programming a sewing pattern by manipulation of jog keys 20 to 23 on the keyboard 10, said sewing pattern being written on a paper sheet to be described, said paper sheet being mounted to work holder 7 while the main shaft 76 is at a standstill and the needle bar 4 is halted in the proximity of the upper dead point.

During such programming, a support pin 194 is mounted to the lower end of the needle bar 4 in place of the needle 3 by manipulation of a screw 193 mounted to the lower end of needle bar 4. A support cylinder 196 is mounted to the lower end of support pin 194 by screw 195 so as to be vertically adjustable, and a programming needle 197 is fitted to the lower end of the sleeve 96.

This programming needle 197 may be conveniently used for accurate programming of sewing data because the needle 197 is positioned sufficiently below the needle bar 4 by virtue of the support pin 194 even if the needle bar 4 is halted near its upper dead point. Thus it is only necessary to have the end of needle 197 positioned in concidence with respective sewing points on the sewing pattern written on the paper sheet.

Next, the control means for controlling the operation of the above mentioned sewing machine will be described in more detail.

Figure 20:
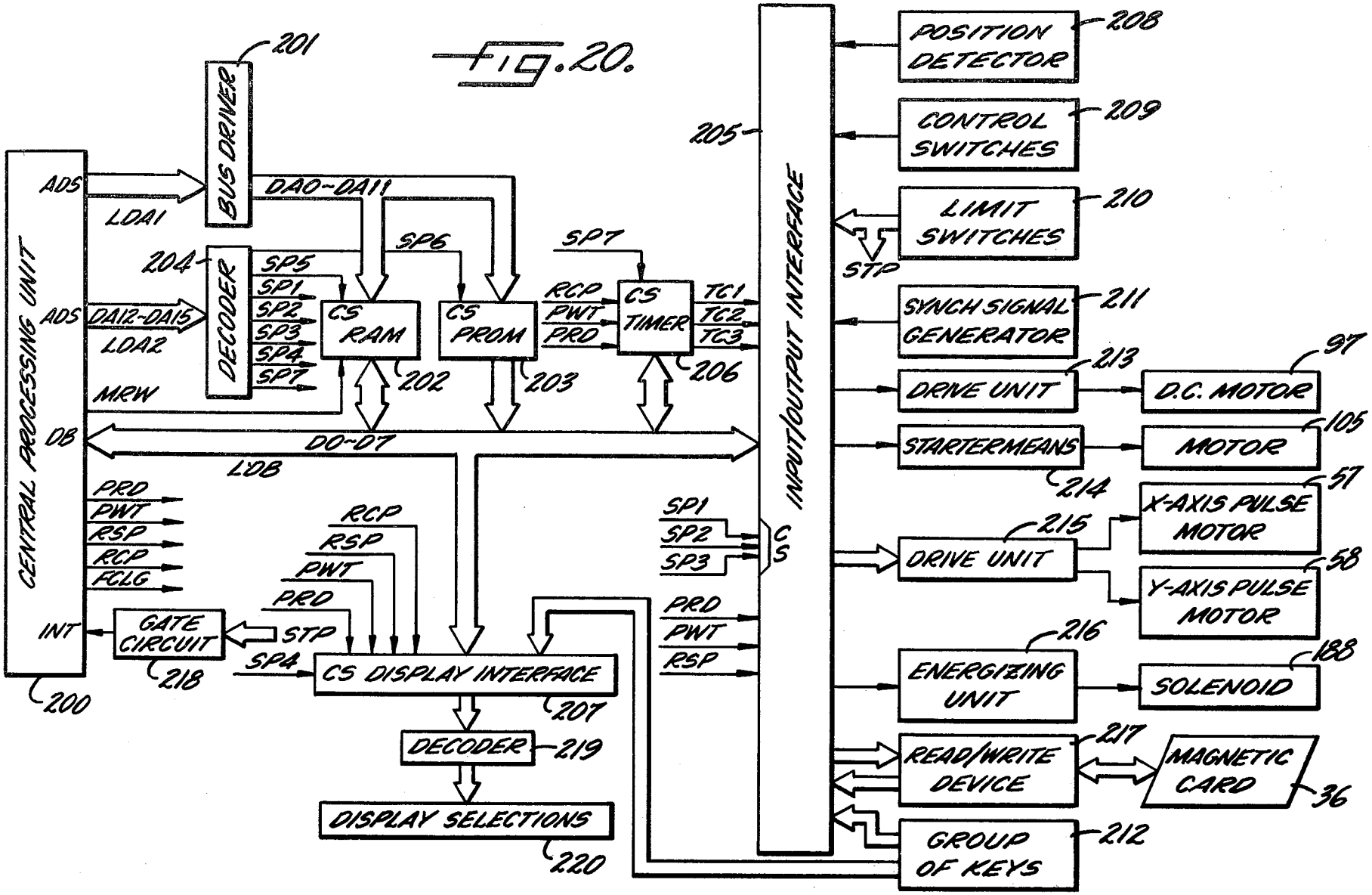
FIG. 20 is a block diagram of electrical components of the sewing machine.
Figures 21, 22, 23:
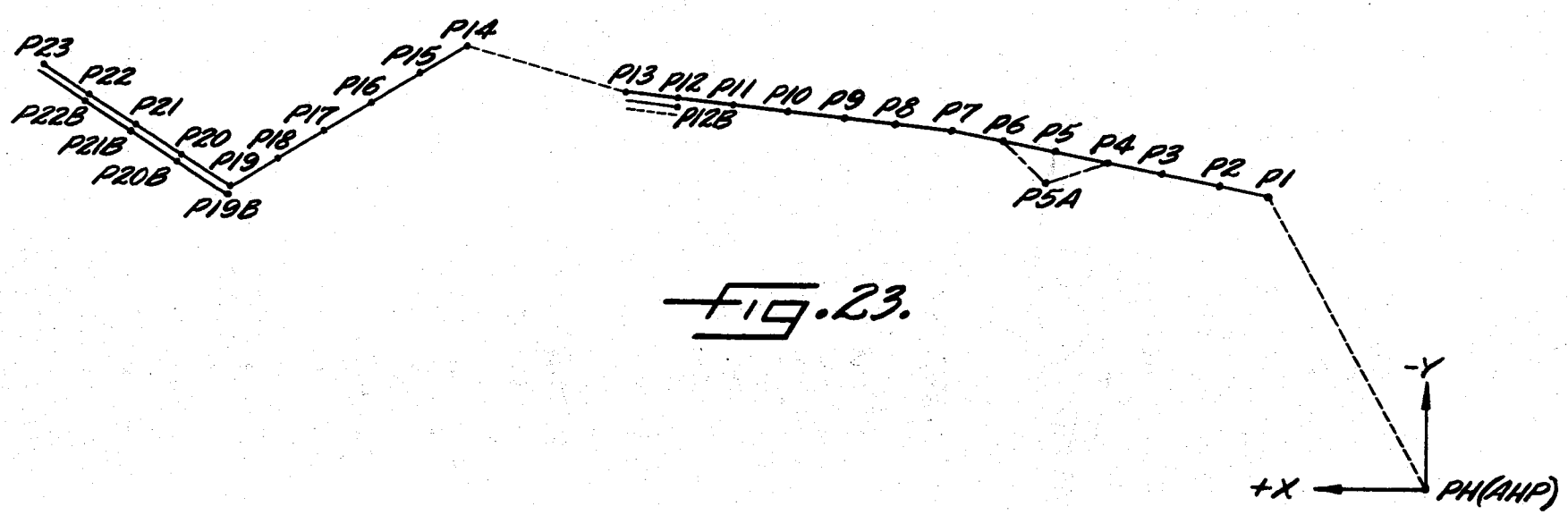
FIG. 21 is an illustrative view showing the architecture of the RAM in FIG. 20.
FIG. 22 is an illustrative view showing the instructions for control of sewing machine operation.
FIG. 23 shows a paper sheet with inscribed sewing points.

Referring to FIG. 20, a central processing unit 200 (hereafter designated as C.P.U.) operates to supply 12-bit address data DA 0 to DA 11 to a random access memory 202 (hereafter designated as RAM) and a programmable read only memory 203 (hereafter designated as PROM) through address bus LDA 1 and a bus driver 201. The C.P.U. 200 may also receive from and transmit to RAM 202 and PROM 203 the 8-bit data through data bus LDB. As shown in FIG. 21, RAM 202 has an operational area used for programming operation and transient storage of instructions obtained by programming and a sewing program area for storage of sewing instructions concerning the direction and magnitude of displacement of the work holder 7. Addresses (2000H) to (20FF) are allotted for operational area and addresses (2100H) to (28FF) are allotted for sewing program area. Instructions for sewing included in the sewing program area may be divided into sewing instructions and feed instructions. The sewing instructions are expressed in binary coded format by using two bytes as shown in FIG. 22. Bits B 0 to B 5 of the first byte represent position or pulse number data DXM corresponding to number of steps of X-axis pulse motor 57 (the magnitude of displacement of work holder 7 along X-axis); bit B 6 represents direction data DSX corresponding to the direction of revolution of X-axis pulse motor 57 (that is, direction of displacement of work holder 7 along X-axis); and bit B 7 represents direction data DSY corresponding to the direction of revolution of Y-axis pulse motor 58 (that is, direction of displacement of work holder 7 along Y-axis). Bits B 0 to B 5 of the second byte represent pulse number data DYM corresponding to the number of steps of Y-axis pulse motor 58; and bits B 6 to B 7 represent the operational command for sewing machine SECT.

The feed instructions are used for shifting said work holder 7 along X- and Y-axes with the motor 105. Two sets of two 2-byte instructions similar to those used for sewing instructions are used as feed instructions (FIG. 37). Thus bits B 0 to B 5 of first byte and bits B 0 to B 5 of third byte (the number of bits, 12) represent pulse number data DXM corresponding to the number of steps of X-axis pulse motor 57; bits B 0 to B 5 of second byte and bits B 0 to B 5 of the fourth byte (the total number of bits, 12) represent the pulse number data DYM corresponding to the number of steps of Y-axis pulse motor 58. In the present example, the logic values (0, 0), (1, 0) and (0 or 1, 1) of the operational command SECT represent "feed", "terminate" and "sew" instructions, respectively.

4-bit address data DA 12 to DA 15 are supplied as input to a decoder 204 from said C.P.U. 200 via address bus DA 2. Seven chip-select signals SP 1 to SP 7 are supplied as output from decoder 204 based on these address data DA 12 to DA 15. Chip-select signals SP 5, SP 6 are supplied to RAM 202 and PROM 203, respectively. The remaining chip-select signals (except SP 5 and SP 6) are supplied to an input/output interface 205, timer 206 and display interface 207 as will be described.

The input/output interface 205 is connected to the control unit 200 through data bus LDB for data reception and transmission, and receives read signal PRD, write signal PWT and reset signal RSP from C.P.U. 200. The interface 205 also receives 2-bit address data DA 0, DA 1 out of address data DA 0 to DA 1 from bus driver 201 and chip-select signals SP 1 to SP 3 from decoder 204 for selection of input and output ports of the interface 205 based on these address data DA 0, DA 1.

Timer 206 is connected to said C.P.U. 200 through data bus LDB for reception or transmission of data or instructions. Read signal PRD and write signal PWT from C.P.U. 200, reference clock pulse signals RCP from clock generator in the C.P.U. 200 and chip-select signal SP7 are supplied as input to timer 206. Timer 206 responds to chip-select signal SP 7 to supply pulse signals TC 1, TC 2 and TC 3 to the input/output interface 205. The pulse signals TC 1, TC 2 are used for producing clock pulse signals to control the operation of said X- and Y-axis pulse motors 57 and 58, while pulse signal TC 3 is used for setting delay time in programming as will be described. These pulse signals TC 1 to TC 3 are selected in accordance with said address data DA 0, DA 1 supplied as input to the input/output interface 205. Moreover, pulse widths and timing of these pulse signals TC 1 to TC 3 are determined in accordance with data and instructions received through said data bus LDB.

Display interface 207 is connected to the C.P.U. 200 by said data bus LDB for data reception and transmission and receives the read signal PRD, write signal PWT, reset signal RSP and clock pulse signal RCP supplied as output from the C.P.U. 200. Chip-select signal SP 4 and address data DA 0 are also supplied to the display interface 207. The address data DA 0 is used for indicating whether the signal received by display interface 207 via data bus LDB and the signal to be supplied by display interface 207 to data bus LDB should be converted into data or instructions. The display interface 207 is also so constructed that, on closure of respective operating keys, the data of the closed key are stored in the internal memory and a signal "1" is transmitted to input/output interface 205. If the signal transmitted to the input/output interface 205 is "1", the C.P.U. 200 reads out the internal memory of the display interface 207 to identify the closed key.

Next, the interconnection between the input/output interface 205 and the external device will be described in detail.

As external devices adapted for transmitting data or signals to the input/output interface 205, there are provided a position detector 208 consisting of the microswitch 100 that is closed upon pressure application to the clamp pedal 39, control switches 209 consisting of the test switch 31 and the emergency stop switches 32, limit switches 210 consisting of X- and Y-axis limit switches 70 and 73, and X- and Y-axis start point limit switches 74, 75, timing signal generator 211 consisting essentially of the hall element 137 and permanent magnet 136 and mounted at back of motor 105 for producing timing signal timed to vertical reciprocation of needle 3, and a group of keys 212 consisting of respective operating keys on the keyboard 10 of the programming case 9, these external devices being connected to input/output interface 205. As external devices adapted for receiving signals from input/output interface 205, there are provided a drive unit 213 for driving the D.C. motor 97 for vertical reciprocation of the presser foot 5, starter means 214 for starting the motor 105, a drive unit 215 for driving said X- and Y-axis pulse motors 57, 58 and an energizing unit 216 for energizing the solenoid 188, these devices being connected to the input/output interface 205.

A read/write device 217 for writing and reading the instructions to and from said magnetic card 36 is also connected to the input/output interface 205.

The position detector 208 operates to transmit an output logic signal "1" to the input/output interface 205 upon pressing of clamp pedal 39 and closure of the microswitch 100, and an output logic signal "0" thereto upon release of pressure applied to the clamp pedal 39 and opening of the microswitch 100.

Referring to control switches 209 consisting of test switch 31 and emergency stop switch 32, test switch 31 is a hold type switch designed to be alternately changed over between opened and closed states upon each depression thereof and to transmit to said input/output interface an output signal changing to logic "1" or "0" depending on whether it is being or opened. Emergency stop switch 32 is of self reset type and transmits output logic signals "0" and "1" to input/output interface 205 upon pressure application and release of pressure application, respectively.

The limit switches 210 are designed for detecting an absolute home position AHP and maximum stroke range of the work holder 7. For instance, when the work holder 7 has been shifted in the positive Y-axis direction in FIG. 5 to cause the follower gear 65 to turn on positive Y-axis limit switch 72 (that is, when the work holder 7 has been shifted beyond allowable stroke extent in the positive Y-axis direction), an output logic signal changing to "0" is transmitted to input/output interface 205 by closure of limit switch 72. Furthermore, when the work holder 7 has been shifted in the negative Y-axis direction to cause said follower gear 65 to turn on the negative Y-axis limit switch 73 (that is, when the work holder 7 has travelled beyond allowable stroke extent in the negative Y-axis direction), an output logic signal changing to "0" is transmitted to input/output interface by closure of the limit switch 73.

Similarly, when the work holder 7 has travelled in the positive X-axis direction to cause said follower gear 64 to turn on said positive X-axis limit switch 70 (that is, when work holder 7 has travelled beyond allowable stroke extent in the positive X-axis direction), an output logic signal changing to "0" is transmitted to the input/output interface 205, based on closure of limit switch. Furthermore, when the work holder 7 has travelled in the negative X-axis direction to cause said follower gear 64 to turn on said negative X-axis limit switch 71 (that is, when the work holder 7 has travelled beyond allowable stroke extent), an output logic signal changing to "0" is transmitted to the input/output interface 205, based on closure of limit switch 71.

Thus, output logic signals transmitted by the limit switches 210 based on the operation of the respective limit switches 70-73 are all "0", as long as the work holder 7 is situated within allowable stroke limits along X- and Y-axes.

On the other hand, when the work holder 7 is positioned at said absolute home position AHP, the X- and Y-axis start point limit switches 74 and 75 are closed by follower gears 64 and 65, and the output signals changing to logic "1" are transmitted by the limit switches 210 to the input/output interface 205. Thus, when the work holder 7 has travelled away from absolute home position AHP, the output signals transmitted from limit switches 74 and 75 are at logic "0".

The output signals STP from the limit switches 70 to 75 are supplied to a gate circuit 218 which is arranged as "OR" circuit. The gate circuit 218 is so designed that, when at least one of the respective signals STP is logic "1", an output logic signal "1" is supplied from the gate circuit to an input terminal INT of the C.P.U. 200 for making an interrupt demand to C.P.U. 200.

The timing signal generator 211 is so designed that, when the needle 3 has been raised to above the upper surface of the needle plate 41, a pulse signal rising from low level (logic "0") to high level (logic "1") and having a constant width is supplied therefrom to the input/output interface 205.

The drive unit 213 is designed for forward and reverse driving of D.C. motor 97. Thus, when an output logic signal "1" is supplied as input from the position indicator 208 to the control unit 200 through the input/output interface 205 (when the clamp pedal 39 is depressed and the microswitch 100 turned on), the C.P.U. 200 operates to processing such signal to transmit an instruction signal to "change to normal drive" to the drive unit 213 through the input/output interface 200. The drive unit 213 responds to this command to change D.C. motor to normal or forward operation so as to raise presser foot 5. On the contrary, when an output logic signal "0" is supplied from the position detector 208 as input to the C.P.U. 200 through the input/output interface 205 (when the pressure application to the clamp pedal 39 is released and the microswitch 100 turned off), an instruction signal to "change to reverse operation" is transmitted from the control unit 200 to the drive unit 213 through the input/output interface 200 for driving the D.C. motor in the reverse direction so as to lower the presser foot 5.

It is to be noted that an output signal FCLG that remains at logic level "0" for a predetermined time, since the closure of the power switch 30 and changes thereafter to logic level "1", is supplied from the C.P.U. 200 to the drive unit 213. Thus, when an instruction signal to "change to normal or forward operation" is supplied as input to the drive unit 213 at the same time that the power switch 30 is closed, the D.C. motor 97 is not driven immediately so that the presser foot 5 is raised only after lapse of said predetermined time.

Starter means 214 consists of a switching circuit such as relay and operates to turn the motor start power source for the motor 105 on or off. Thus, motor 105 is started by start instruction signal from the C.P.U. 200 transmitted through the input/output interface 205.

The drive unit 215 is designed for forward and reverse operation of X-axis and Y-axis pulse motors 57 and 58. Thus, by said sewing and feed instructions as read-out from RAM 202 and by operation of said X-axis and Y-axis jog keys 20 to 23, said drive unit 200 operates to transmit a instruction signal to the drive unit 205 through the input/output interface 205. The drive unit 215 is responsive to this instruction signal to drive X-axis and Y-axis pulse motors 57, 58 by a predetermined number of steps in the forward or reverse direction for shifting the work holder 7 in the positive or negative X-axis direction and the positive or negative Y-axis direction.

Said energizing unit 216 is designed to receive an energization instruction signal from the input/output interface 205 and to energize said solenoid 188 in response to such instruction signal to validate the operation of the thread cutting mechanism 143 and the motion control mechanism 108 brought about by said cam mechanism.

Read/write device 217 receives as input from the input/output interface 205 such signals as data signals, write reference clock pulse signals, read/write control signals, initializing signals for initialization of amplifiers for five magnetic heads in read/write device 217 and feed direction instruction signals for magnetic card 36. When the read/write control signal is the read instruction, read/write device 217 writes the data signals and said clock pulse signals on the magnetic card 36 sequentially. On the contrary, when the read/write control signal is the write instruction, the read/write device 217 retrieves the clock pulse track and data track for said magnetic card 36 to output to the input/output interface 205 a sewing instruction stored in the magnetic card 36.

The read/write device 217 has a read-switch, not shown, that is turned on when the magnetic card 36 is inserted into the opening 37 of control panel 29 (FIGS. 1 and 4). Upon closure of this read switch, a card loading signal going from logic "0" to logic "1" is supplied to the input/output interface 205.

The key group 212, consisting of the operating keys for supplying input "on" signals to the input/output interface 205 and the display interface 207, will be described in detail.

Said programming key 11 is a normally open self reset type switch used for program start and, when the key 11 is turned on by finger pressure, the "on" signal is supplied to said input/output interface 205.

Said reset key 12 is similarly a normally open self reset type switch and supplies an "on" signal to said display interface 207 to cause said C.P.U. 200 to clear the commands stored in the operational area of RAM 202 or clear sewing instructions stored in sewing program area of RAM 202 in cooperation with numerical key '2' of the numerical key group 17. Said end key 13 is similarly a normally open self reset type switch and supplies an "on" signal to the display interface 207 to cause said C.P.U 200 to store end instruction code instructing the sewing program area of RAM 202 the end of sewing instructions in cooperation with said numerical key '1'.

The load key 14 is similarly a normally open self reset type switch and supplies an "on" signal to the display interface 207 to cause said C.P.U. 200 to store in sewing program area of RAM 202 sewing and feed instructions as set by the operation of said X-axis and Y-axis jog keys 20 to 23. Feed key 15 is similarly a normally open self reset type switch and supplies an "on" signal to the display interface 207 for setting said feed instructions in sewing program area of RAM 202. The cancel key 16 is similarly a normally open self reset type switch and supplies an "on" signal to the display interface 207 for correcting the sewing and feed instructions as stored in the sewing program area of RAM 202.

The keys of the numerical key group 17, corresponding to digital figures '0' to '9' are also normally open self reset type switches and are used in conjunction with operation of said reset key 12, end key 13, plus key 18 and minus key 19, with their "on" signals being transmitted to display interface 207. Said plus key 18 is also a normally open self reset type switch and supplies an "on" signal to display interface 207 in cooperation with said key group 17 to cause said C.P.U. 200 to increment and sequentially read out the sewing and feed instructions sequentially stored in the respective addresses of the sewing program area of RAM 202, to drive said X-axis and Y-axis pulse motors 57, 58 based on the read-out instructions and to shift the work holder 7 in the sewing end direction by a predetermined number of steps as determined by the operation of said key group 17. Thus, upon depression of the numerical key '3' followed by depression of the plus key 18, the work holder 7 is moved from sewing start position (or absolute home position or any predetermined sewing position) stepwise by three steps in accordance with the above instruction.

Said plus key 18 may also be used in cooperation with the cancel key 16 to correct sewing and feed instructions stored in the sewing program area of RAM 200.

Said minus key 18 is similarly a normally open self reset type switch and supplies an "on" signal by cooperation with said numerical key group 17 to cause said C.P.U. 200 to sequentially decrement and read-out sewing and feed instructions as sequentially stored in each address of sewing program area of RAM 200, to drive said X-axis and Y-axis pulse motors 57 and 58 based on the read-out data and to shift said work holder 7 stepwise in the direction of sewing start point by a certain number of steps as determined by the operation of said key group 17. Thus, upon depression of the numerical key "8" followed by depression of minus key 19, the work holder 7 is moved from its stop position stepwise by eight steps in the direction of said sewing start point. Similarly to the plus key 18, the minus key 19 may be used in conjunction with the cancel key 16 to correct the sewing and feed instructions as stored in the sewing program area of RAM 202.

The X-axis jog keys 20 and 21 are also normally open self reset type switches and, on depressing these keys 20 and 21, pulse signals are supplied to the input/output interface 205 for shifting the work holder 7 in the positive X-axis direction and in the negative Y-axis direction in FIG. 5, respectively. The Y-axis jog keys 22 and 23 are also normally open self reset type switches and, upon depression of these keys 22 and 23, pulse signals are supplied to the input/output interface 205 for shifting said work holder 7 in the positive Y-axis direction and negative Y-axis direction in FIG. 5, respectively.

Displacement of the work holder 7 in the directions of X- and Y-axes is dependent on the direction of revolution and numbers of steps of the X-axis and Y-axis pulse motors 57 and 58. The direction of revolution of the motors 57 and 58 is decided by which of the X-axis and Y-axis jog keys 20 to 23 are operated, whereas the number of steps is decided by the number of pulse signals supplied by operation of said jog keys 20 to 23. The data concerning the direction of revolution and number of steps are stored in each address of sewing program area of RAM 202 as direction data DSX, DSY and step number or position (pulse number) data DXM, DYM in the manner to be described below.

Next, the group of display sections consisting of the feed lamp 24 connected to the display interface 207 through the decoder 219, the cancel lamp 25 and respective display sections 26 to 28 of the seven segment type, will be described in detail.

The feed lamp 24 is lighted upon pressing said feed key 15, while the cancel lamp 25 is lighted upon pressing said cancel key 16. The numbers of pulse signals, supplied by pressing said X-axis jog keys 20 and 21, are displayed in the X-axis display section 26. Similarly, the numbers of pulse signals, supplied on pressing said Y-axis jog keys 22 and 23, are digitally displayed in the Y-axis display section 27. Digital figures are displayed in numerical display section 28 depending on actuation of the numerical keys "0" to "9".

The operation of the control device will be described by referring to flow charts shown in FIGS. 24 to 35 illustrating the operational sequence in the C.P.U. 200.

For sake of clarity, the various operations or actions of the C.P.U. 200 are classified into six actions, namely (i) programming operation for programming suitably designed sewing pattern instructions in RAM 202; (ii) write operation for writing into magnetic card 36 the instructions stored in RAM 202; (iii) card read-out operation for correcting the instructions on the magnetic card 36 into instructions for actual sewing and storing them in RAM 202; (iv) sewing operation for actuating the sewing machine in accordance with such instructions for actual sewing; (v) test operation for test shifting said work holder 7; and (vi) correcting operation for instructions. These actions or operations will be discussed separately below.

(i) Programming Action

First, explanation is made of a programming action based on a paper sheet, not shown, bearing a sewing pattern selected by operator (in this example, a sewing configuration as shown in FIG. 23 composed of sewing line or feed line interconnecting a point PH corresponding to an absolute home position AHP and various sewing points P1 to P23).

When the power switch 30 is turned on, with the work holder 7 being at absolute home position AHP, the C.P.U. 200 follows the program stored in PROM 203 to initialize the input/output interface 205, timer 206 and display interface 207, and to output to drive unit 213 an output signal "213" which has changed from logical "0" to logical "1" to cause D.C. motor 97 to operate in the normal direction. The C.P.U. 200 then clears the operational area of RAM 202 (an area from address 200 to address 20FF) to ready for the operator's next operation.

The operator then presses clamp pedal 39 to raise the work presser plate 46 of the work holder 7 and places the paper sheet on the work holder 7, bearing in mind that the point PH inscribed on said paper sheet coincides with the needle drop point. At this time, the D.C. motor 97 tends to be driven in normal and reverse operation (FIGS. 24 and 31) by depression of the clamp pedal 39 for vertically reciprocating the presser foot 5, but the motor 105 is still halted and thus the presser foot 5 is maintained at an elevated position as is the needle 3.

Figure 29:
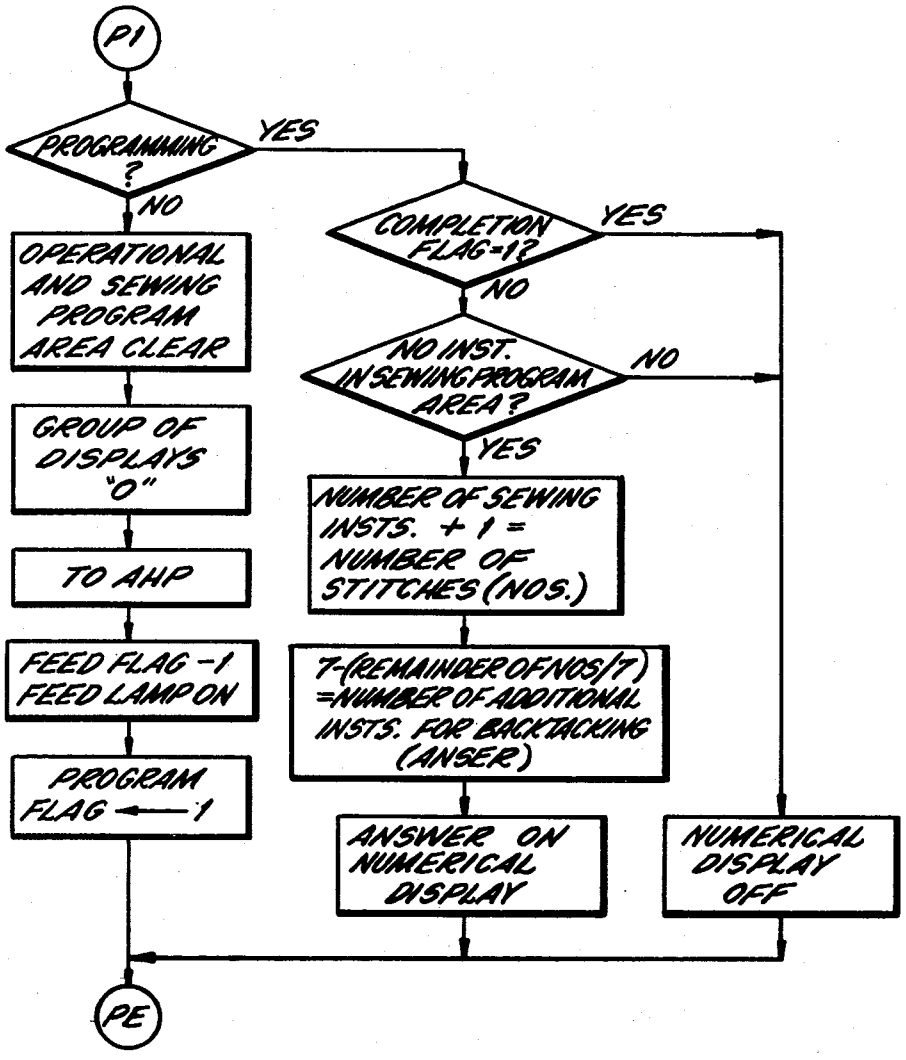

When the programming key 11 is turned on, with said paper sheet mounted in position in the work holder 7, the C.P.U. 200 then proceeds to an operational procedure in accordance with the flow chart shown in FIG. 29. Thus, C.P.U. 200 checks in the initialization that program flag is "0" and hence that the mode is not the programming mode. The C.P.U. 200 then clears operational area and sewing program area of RAM 202, displays "0" in the X-axis display section, Y-axis display section 27 and numerical display section 28 and shifts the work holder 7 to the absolute home position AHP, unless the work holder 7 is already positioned at AHP. The C.P.U. 200 then lights the feed lamp 24 and sets feed flag and said program flag to zero.

The work holder 7 is at a standstill because it is initially at the absolute home position AHP. Therefore, if the work holder 7 is not initially at the absolute home position AHP, the operator proceeds to mounting the paper sheet on the work holder 7.

Figure 24:
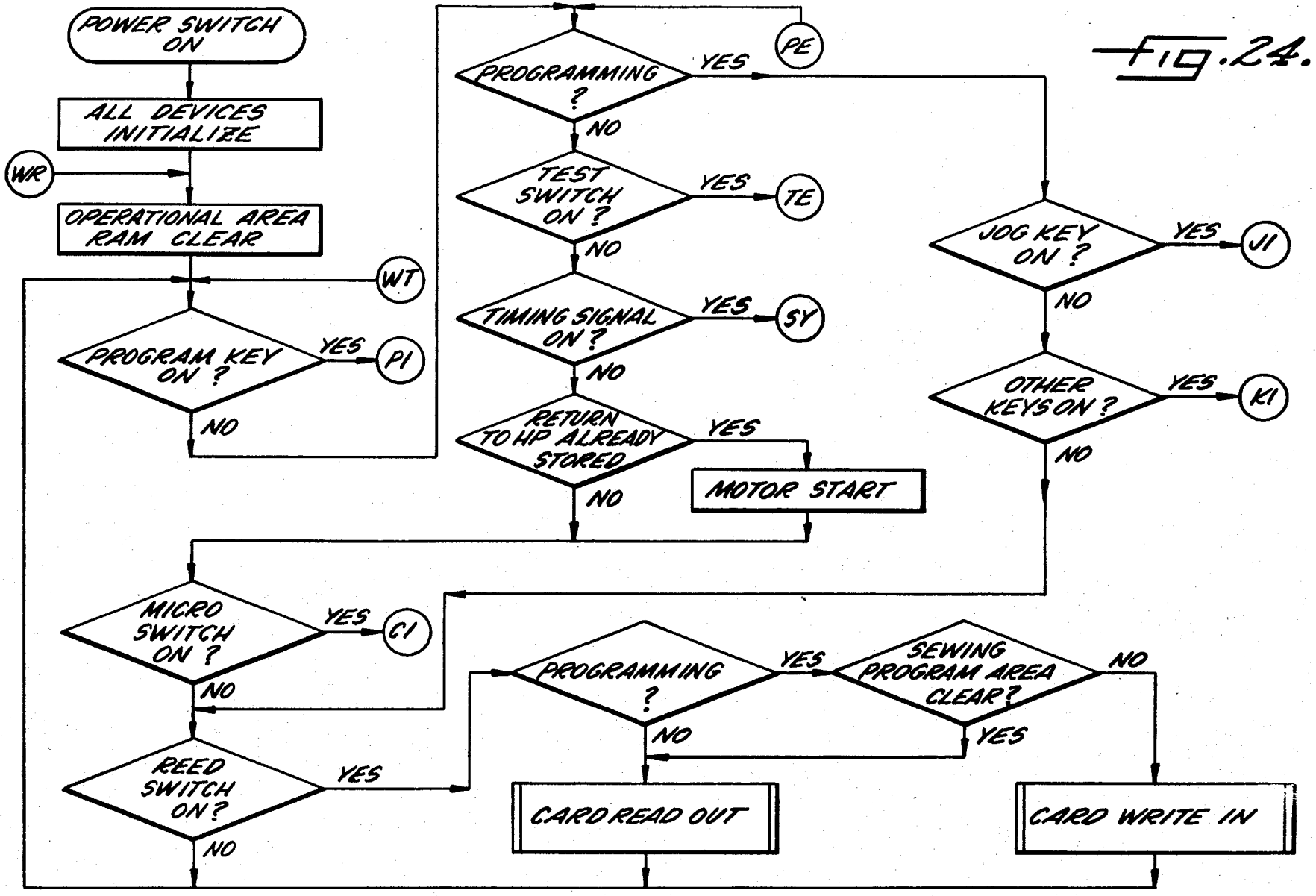

With program flag set to "1", the C.P.U. 200 waits for operation of the X-axis and Y-axis jog keys 20 to 23 and other operating keys 11 to 13, in accordance with the flow chart shown in FIG. 24. On operating the positive and negative X-axis and Y-axis jog keys 20 and 23 for shifting the work holder 7 so that sewing point P1 inscribed on said paper sheet is brought into register with needle drop point, C.P.U. 200 proceeds to the operational procedure in accordance with the flow chart shown in FIG. 30. Supposing for the sake of explanation that the positive X-axis jog key 20 is operated and a pulse signal is applied to the input/output interface each time the key is closed, the C.P.U. 200 senses which of the jog keys has been operated and checks the pulse signal on each application of each "on" signal to cause the X-axis pulse motor 57 to rotate a predetermined angle. The C.P.U. 200 also causes a pulse counter in RAM 202 to count the number of pulse signals supplied and causes such number to be digitally displayed in X-axis display section. Thus, in checking this pulse signal, the C.P.U. 200 checks whether the same jog key has been operated, whether the feed flag is "1" or "0" whether the sewing pitch is within prescribed range. The sewing pitch designates the distance traversed by the work holder 7 stepwise by revolution of X-axis and Y-axis pulse motors 57 and 58 during the time that the needle 3 completes one cycle of vertical reciprocation through the needle plate 41. In this embodiment, the number of pulse signals is 15 and hence the sewing pitch corresponds to 15 steps of pulse motors 57 and 58. If the same jog key is still turned on and the feed flag is "1" (thus regardless of the check whether sewing pitch is within prescribed range) or if the same jog key is turned on and the feed flag is "0" but the sewing pitch is within prescribed range, the C.P.U. 200 causes the pulse motor 57 to rotate each time a pulse signal is supplied, at the same time causing the number of input pulse signals to be counted in pulse counter in RAM 202, and displays the number in the X-axis display section 26. If the same jog key is turned on and feed flag is "0" but sewing pitch is not within prescribed range, the C.P.U. 200 waits for turning off of such jog key and then proceeds to the flow chart shown in FIG. 24.

Since control C.P.U. 200 has the repeat function, the above pulse signals are produced in succession at predetermined time intervals, as long as the positive X-axis jog key 20 as well as the jog keys 21 to 23 are kept closed. Thus, if the X-axis jog key 20 is kept closed, with feed flag set to "1", work holder 7 can be shifted continuously in the direction of positive X-axis.

Then, by operating the negative Y-axis jog key 23 and by having each one pulse signal supplied to the input/output interface 205 on each closure of such key, the C.P.U. 200 causes the operation of the Y-axis pulse motor 58 to be reversed on application of each pulse signal, causes the pulse counter to count the number of pulse signals, and displays the number in the Y-axis display section 27.

Thus, when work holder 7 has been shifted by manipulation of positive X-axis and negative Y-axis jog keys 20 and 23 to shift the work holder 7 so that sewing point P1 on said paper sheet is coincident with needle drop point, and the load key 14 is then closed, C.P.U. 200 proceeds in checking of "on" signal of this load key 14 and then to the operational procedure in accordance with the flow chart shown in FIG. 26.

After check of the 'on' signal caused by load key 14, the C.P.U. 200 checks the number of pulses counted in each pulse counter in conjunction with operation of the positive X-axis jog key 20 and negative Y-axis jog key 23. If, upon check, the contents of each pulse counter are not zero, the C.P.U. 200 checks that work holder 7 is not at absolute home position and whether the instruction is that for sewing or feed (if the feed flag is '0', the instruction is for sewing and, if the feed flag is '1', the instruction is for feed). If the feed flag is '1', C.P.U. 200 converts the data of the two pulse counters originating from operation of jog keys 20, 23 into said feed instructions and stores the latter in the operational area register of RAM 202.

The C.P.U. 200 then checks that no instructions are stored in predetermined addresses of sewing program area of RAM 202, in order to transfer the instructions stored in said operational area register into these addresses. Since the sewing program area is cleared at this time and no instructions are stored in respective addresses, the C.P.U. 200 shifts the instructions in said operational area register into addresses (2103) to (2106) of the sewing program area.

Following such transfer of feed instructions from operational area register to sewing program area, the C.P.U. 200 operates to increment the sewing program area address to address (2107), to reset the two pulse counters, to set said feed flag and other flags except said program flag to '0' and to display '0' in X-axis and Y-axis display sections 26 and 27 to wait for next key manipulation.

In order to shift work holder 7 so that the next sewing point P2 on the paper sheet is positioned at the needle drop point, the operator then manipulates X-axis and Y-axis jog keys 20 to 23. In this case, as apparent from FIG. 23, the X-axis jog key 20 of the positive X-axis direction and the Y-axis jog key 23 of the negative Y-axis direction are used as before. The control C.P.U. 200 then proceeds to operational procedure as before in accordance with the flow chart of FIG. 30 to shift the work holder 7 to such a position that the sewing point P2 is coincident with the needle drop point, to cause the two pulse counters to count the number of pulses originating from closure of the jog keys 20 and 23 and digitally display the respective numbers of pulses in said X-axis and Y-axis display sections 26 and 27.

Next, upon closure of the load key 14 by the operator, the C.P.U. 200 proceeds to the operational procedure in accordance with the flow chart shown in FIG. 26. Since feed flag is '0', the C.P.U. 200 sees that the instruction is that for sewing, in the stage of checking whether the instruction is the sewing instruction or not. Thus, C.P.U. 200 converts the data of the two pulse counters originating from operation of said jog keys 20, 23 into said sewing signals, instead of converting them into said feed signals, and stores these instructions in operational area register of RAM 202. The C.P.U. 200 then proceeds in the similar manner as described above to shift the sewing instructions from operational area register into predetermined addresses of sewing program area, to reset the pulse counters and to wait for next key manipulation for programming the sewing instructions at the next sewing point P3.

After completion of the program up to sewing point P13, the feed intructions at sewing point P14 are formulated (FIG. 23). On closure of the feed key 15 by the operation, C.P.U. 200 checks the 'on' signal originating from closure of the feed key 15 and sets the feed flag to '1', while lighting the feed lamp 24. Then, on operation of the positive X-axis and negative Y-axis jog keys 20 and 23, control unit 200 executes an operational sequence in accordance with flow chart shown in FIG. 30 so as to cause X-axis and Y-axis pulse motors 57 and 58 to be revolved to shift the work holder 7 to such position that the sewing point P14 coincides with the needle drop point, to cause the pulse counters to count the number of pulses originating from closure of the positive X-axis and negative Y-axis jog keys 20 and 23 and digitally display the respective numbers of pulses in the X-axis and Y-axis display sections 26 and 27.

Next, upon closure of the load key 41 by the operator, the C.P.U. 200 proceeds to an operational sequence in accordance with the flow chart shown in FIG. 26. Since the feed flag is '1' due to closure of the feed key 15, feed instructions at sewing point P14 may be formulated similarly to the programming of the feed instructions at sewing point P1 with the work holder 7 shifted from the point PH corresponding to absolute home position AHP to sewing point P1. The feed instructions thus formulated are stored in predetermined addresses of the sewing program area in the similar manner to complete the programming at sewing point P14.

Data programming procedure for sewing instructions from point P15 to point P23 is the same as that from point P2 to point 13 and therefore detailed explanation for such procedure is omitted for brevity.

For completing the programming procedure with completion of data programming for the sewing instructions of sewing point P23, the operator turns off the numerical key '1' three times for preventing erroneous actuation of the end key 13 to be later described. The C.P.U. 200 then proceeds to execution of operational sequence in accordance with the flow chart of FIG. 25 for displaying (1, 1, 1) in the numerical display section 28. On closure of the end key 13 by the operator, the C.P.U. 200 checks the 'on' signal originating from closure of end key 13 to set end flag to '1', and also checks that the numerical key for '1' has been closed three times, in accordance with the flow chart of FIG. 25.

The C.P.U. 200 then checks whether the address of the sewing program area in which sewing instructions at sewing point P23 are stored is less than (24 FF) and, depending on check results, causes an instruction code to be stored in address (2100), said instruction code instructing whether one or both memory surfaces of the magnetic card 36 are required for storing the instructions. The C.P.U. 200 also causes an end code to be stored in the sewing program area at the address following that storing the sewing instructions for point P23, such end code instructing the program end. The C.P.U. 200 then clears the addresses of the sewing program area following the address in which the end code has been stored and sets the display in the numerical display section 28 to '0' and program flag from '1' to '0'. The program formulation shown in FIG. 36 is now completed and the C.P.U. 200 causes said X-axis and Y-axis pulse motors 57 and 58 to be driven stepwise to shift work holder 7 to such a position that said sewing point P1 (designated hereafter as sewing start point) is brought to the needle drop point.

During programming procedure, as at sewing point P13 or P23, it may be checked whether the number of stitches is consistent with the number of stitches that may be halted by the cam mechanism as motion control mechanism. In case of inconsistency, the number of stitches to the next stop point may be grasped as follows, and are used as back tacks.

The load key 14 is closed as at sewing point P13 to store the sewing instructions in the sewing program area and the programming key 11 is closed. The C.P.U. 200 then proceeds to execution of the operational sequence in accordance with the flow chart shown in FIG. 29. Since at this time the program flag is set to '1', it is seen that the mode is the programming mode. The C.P.U. 200 then checks that end flag is not set to '1', because end key 13 is not closed. The C.P.U. 200 then checks that there are no data in said sewing program area and calculates the number of stitches NOS by adding '1' to the number of sewing instructions for points P2 to P13 (P15 to P23 in case of operation at sewing point P23) or '12'.

With the number of stitches NOS thus obtained, the C.P.U. 200 executes an operation of the following formula (1) for obtaining the number of additional instructions for back-tacking the number of stitches required to reach the next stop point ANSER and digitally displays the number of back-tacking ANSER on said numerical display section 28.

$$7-(\text{remainder of NOS}/7)=\text{number of additional instructions for back-tacking ANSER} \quad (1)$$

In the above formula (1), the figure '7' stands for the number of stitches that may be halted by first control cam 172.

In this case, remainder of NOS/7 is '6' and the number of additional instructions for back-tacking ANSER is '1'. Similarly, the number of additional instructions for back-tacking ANSER at sewing point 23 is '4'.

It is to be noted that, after completion of programming procedure and in the absence of sewing instructions in sewing program area, simply the numerical display 28 is turned off and the above procedure does not take place.

(ii) Card Write Operation

Card write operation in which the sewing instructions and feed instructions, stored in the sewing program area of RAM 202 as shown in FIG. 36, as are stored in said magnetic card 36, will be discussed below.

As magnetic card 36 is inserted into opening 37 of control panel 29, the reed switch in read/write device 217 is turned on. As shown in FIG. 24, C.P.U. 200 checks that, with the reed switch turned on (card loading signal being '1') and program flag being set to '0', the mode is the program mode and the sewing program area is not cleared. The C.P.U. 200 then proceeds to operational sequence in accordance with the read subroutine shown in FIG. 34.

The C.P.U. 200 causes the magnetic card 36 to progress and causes the sewing card and feed instructions in addresses (2100) to (24 FF) of the sewing program area of RAM 202 to be converted to card data and stored on one surface of magnetic card 36. In this example, the instructions are stored in addresses (2100) to (2136) as shown in FIG. 36 and thus may be stored on only one side of the magnetic card 36.

On completion of storage of the above instructions, C.P.U. 200 causes magnetic card to be receded and said reed switch to be turned off (card loading signal to be set to '0') to check the instruction code stored in address (2100), that is, whether storage on one surface of magnetic card 36 will be sufficient. Since this is true in the present example, card write operation is now completed.

In case there are many sewing and feed instructions and hence these instructions are necessarily stored on both sides of magnetic card 36, C.P.U. 200 causes emergency stop lamp 35 to be flashed, after the above check, and waits for the storage operation on the other surface of magnetic card 36. The magnetic card 36 is inserted into opening 37, with blank side towards front to effect the storage as described above. The sewing and feed instructions stored in addresses (2500) to (28 FF) in said sewing program area are now stored in magnetic card 36.

(iii) Card Read Operation

The procedure of correcting the instructions stored in magnetic card into actual sewing instructions and storing them in the sewing program area of RAM 202, will be described below.

Figure 35:
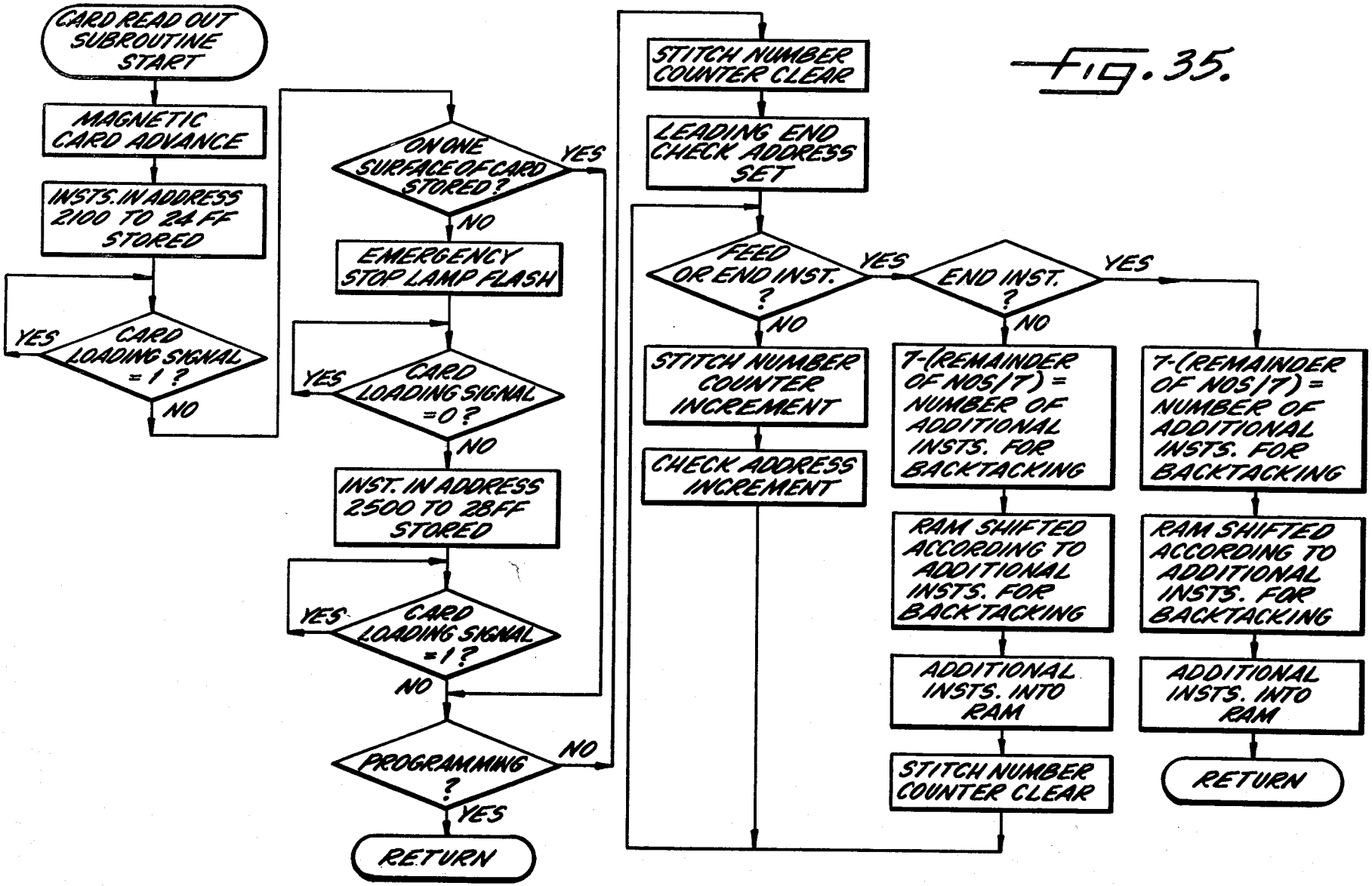

With magnetic card 36 inserted into opening 37 in control panel 29, and the reed switch in said read/write device 217 turned on, C.P.U. 200 checks that said reed switch is turned on and that the mode is not the program mode, and proceeds to an operational sequence in accordance with card read subroutine (FIG. 35).

The C.P.U. 200 causes the magnetic card 36 to progress, converts the instructions stored on one side of magnetic card 36 into sewing instructions and feed data instructions and stores them in addresses (2100) to (24 FF) of said sewing program area. On completion of writing of the instructions, the C.P.U. 200 causes magnetic card 36 to be receded and said reed switch to be turned off. The C.P.U. 200 then checks whether the instructions are stored on one or both sides of magnetic card 36, in consideration that instructions should be stored on one side only in the present example. In case of inconsistency between the number of stitches referenced to the stored sewing and feed instructions and the number of stitches that may be halted by operation of motion control mechanism 108 and said cam mechanism, the C.P.U. 200 calculates the number of stitches up to the next stop time by said cam means point and proceeds to an operational procedure to produce additional instructions for the stitch number.

After check that program formulation is continued, the C.P.U. 200 clears the stitch number counter used for obtaining the number of stitches NOS and sets the sewing program area address to an address (2107) (leading and check address) wherein sewing instructions for one stitch at point P1 to P2 are stored. The C.P.U. 200 then checks that the instructions in said address (2107) are neither feed instructions nor end instructions. The C.P.U. 200 then increments the number of needles counter by '1', increments the address to address (2109) wherein sewing instructions for one stitch for next sewing points P2 to P3 are stored, and again checks that the instructions contained in such address are neither feed instructions nor end instructions.

Similar check is repeatedly made up to address (2110) where sewing instructions for one stitch for sewing points P12 to P13 are stored. Then, feed instructions in the address (212 F) are checked. Based on instruction check, the C.P.U. 200 divides the number of stitches (NOS) counted in said number of stitches counter by '7' and subtracts the remainder (integer) from '7' to obtain the number of additional instructions for back-tacking, which in this example is '1'.

With the number of additional instructions thus obtained, the C.P.U. 200 shifts the instructions in said sewing program area for inserting the additional instructions, that is, the sewing instructions for one stitch from sewing point P13 to sewing point P12 (P12 B) and the feed instructions from sewing point P12 (P12 B) to sewing point P13, between the sewing instructions from sewing point P12 to sewing point P13 and the feed instructions between sewing points P13 and P14, operates and inserts the two instructions into vacated addresses and clears the stitch number counter. The one-stitch additional instructions from sewing point P13 to sewing point P12 (P12 B) are the same as one-stitch sewing instructions from sewing point P12 to sewing point P13, except that direction data DSY, DSX are reversed, as will be obvious from FIG. 37. It is seen from this that the needle 3 will drop to sewing point P12 in the additional instructions from sewing point P13 to sewing point P12 (P12 B). Moreover, as will be obvious from FIG. 37, the feed instructions from sewing point P12 (P12 B) and sewing point P14 are stored as newly operated feed instructions from sewing point P12 (P12 B) to sewing point P13 and the preceding feed instructions from sewing point P13 to sewing point P14, there is no risk that the work holder 7 may impinge on presser foot 5 due to direct feed from sewing point P12 (P12 B) to sewing point P14.

The C.P.U. 200 then checks from sewing point P15 to sewing point P23 and finally checks the address storing the program end instructions.

The C.P.U. 200 checks that the instructions are the program end instructions and calculates as before the number of additional instructions for back-tacking by dividing the number of stitches NOS as counted at the number of stitches counter by "7" and subtracting the integral remainder from 7. The result is "4" in the present example.

With the number of additional instructions for back-tacking thus obtained, the C.P.U. 200 shifts the sewing program area instructions (in this case, program end instructions) for inserting four stitch sewing instructions from sewing point P23 to sewing point P19, between sewing instructions from sewing point P22 to sewing point P23 and the program end instructions, operates and inserts said four-stitch sewing instructions into the thus vacated addresses (FIG. 37) to complete card read operation. These additional instructions for back-tacking are similarly different only as to direction data DSY, DSX, as shown in FIG. 37, and the needle will drop at sewing points P22, P21, P20 and P19.

(iv) Sewing Operation

The sewing operation will be explained below wherein work holder 7 is moved stepwise for each stitch based on sewing and feed instructions that are corrected by the card read operation (FIG. 37).

If, on completion of card read operation by C.P.U. 200, the operator presses down the emergency stop switch 32, the C.P.U. 200 shifts to an interrupt routine (FIG. 33), checks that there exists neither the sewing state nor the abnormal state as indicated by EM flag, causes motor 105 to halt if the motor is running (motor 105 is halted at this time), sets the return to start point flag to "1" and causes the X-axis and Y-axis pulse motors 57, 58 to be rotated stepwise for shifting the work holder 7 first to absolute home position AHP and then to sewing start point P1 (return to origin or start point). The C.P.U. 200 then proceeds to execution of the operational sequence as indicated in the flow chart of FIG. 24, checks the return to start state (as indicated by return to start flag "1") and data read into magnetic card 36 and causes starter means 214 to start the motor 105.

Figures 28, 31:
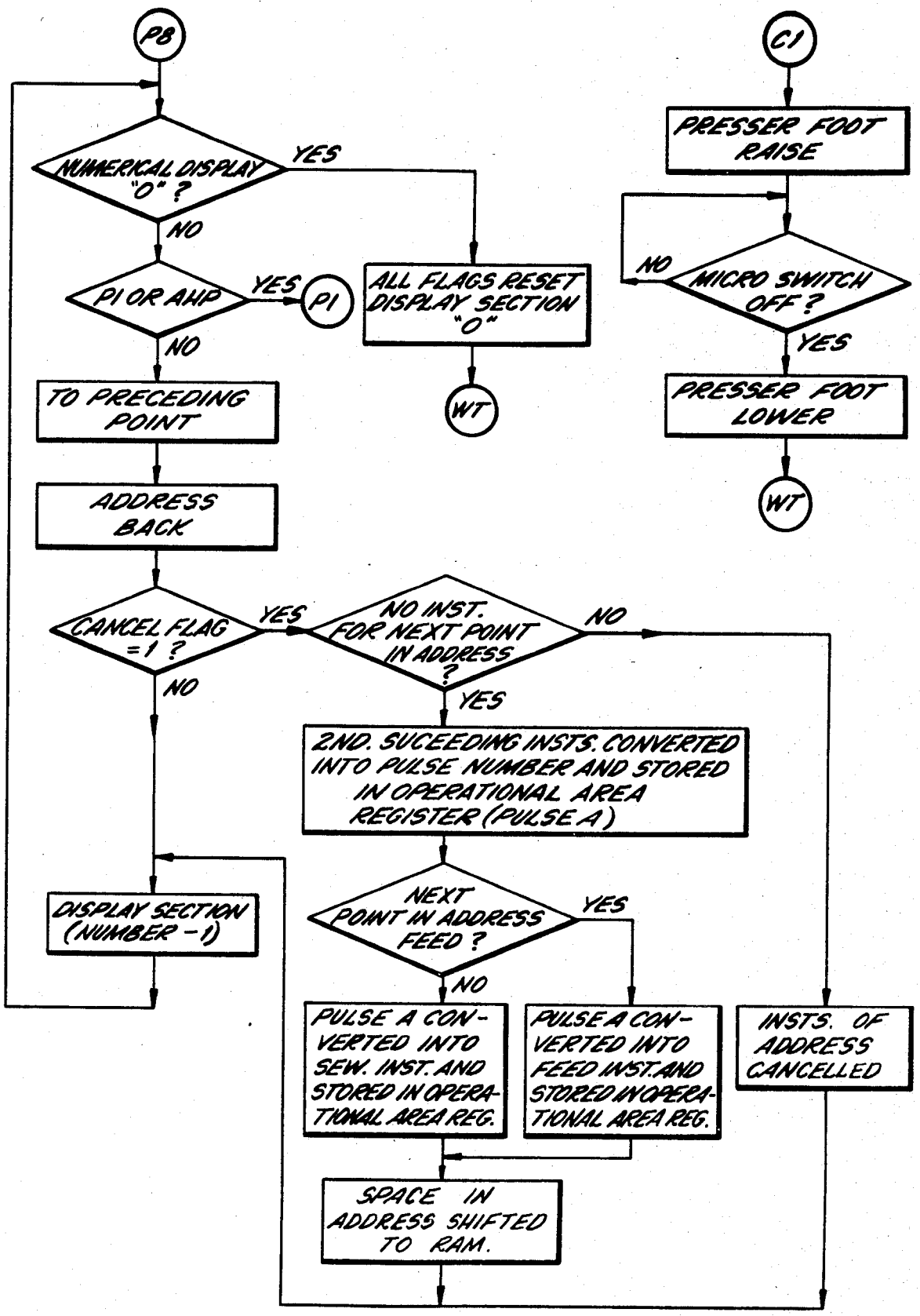
Figure 30:
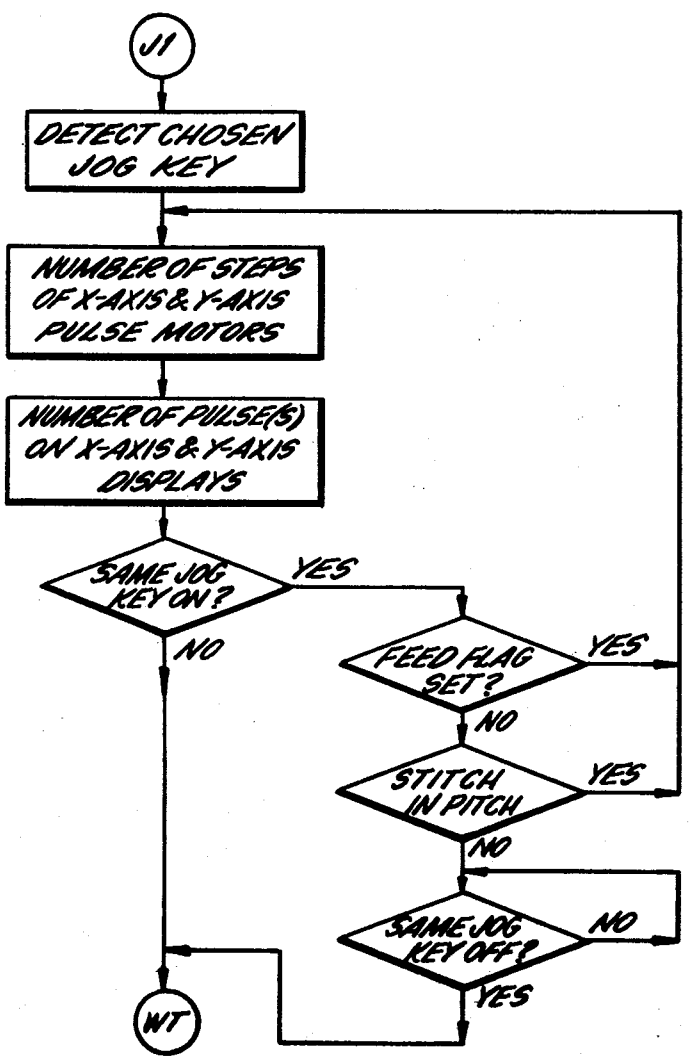

The operator then presses down the clamp pedal 39 and places work fabric 8 on the work holder 7, while the C.P.U. 200 is executing the operational procedure in accordance with the flow chart shown in FIG. 31. The operator then presses down start pedal 38 to start the sewing, at the same time that on/off timing signals are produced by the timing signal generator 211, the "on" signal appearing when the needle 3 has been elevated slightly above the work fabric support plane. The C.P.U. 200 responds to these timing signals to execute the operational procedure in accordance with the flow chart shown in FIG. 32.

The C.P.U. 200 checks from the timing signals of the timing signal generator that main shaft 76 is in rotation and that return to start flag is not "0". The C.P.U. 200 then sets the address counter in consideration that first stitch is at sewing point P1, checks whether the instructions after five stitches to come, that is, the instructions of address (211 F) in FIG. 37 are feed instructions or end instructions, and causes the pulse motors 57 and 58 to rotate stepwise based on sewing instructions from sewing point P1 to sewing point P2 to shift the work holder 7.

The C.P.U. 200 then checks that the mode is sewing mode, based on sewing flag indication, and that the instructions in the next execute address (2109) are not the feed instructions, causes the number of stitches counter to count the number of executed instrutions (number of executed instruction stitches) and checks that EM flag to be described is "0" and test switch 31 is not turned on. Thus, sewing of second stitch is completed (sewing point P2).

The sewing instructions for respective execute addresses up to execute address (212 F) are read in the same way as described above and the work holder 7 effects a stepwise movement from sewing point P1 up to sewing point P13 and a stepwise movement for back tack from sewing point P13 up to sewing point P12 (P12 B) based on the respective instructions. At the time of completion of sewing at sewing point P10 (tenth stitch) it is checked that the instructions at the fifth stitch to come are the feed instructions from sewing point P12 (P12 B) to sewing point P13, and thus the solenoid 188 is energized. On completion of sewing at sewing point P12 (P12 B), the motion control mechanism 108 and thread cutting mechanism 143 are actuated for halting the needle 3 at an elevated position and holding and cutting the upper and lower threads connecting to the work fabric 8. On completion of sewing at sewing point P12 (P12 B) and at the stage of checking whether the next instructions are feed instructions or not, the C.P.U. 200 causes the work holder 7 to be fed to sewing point P14 based on the feed instructions from sewing point P12 (P12 B) to sewing point P13 and from sewing point P13 to sewing point P14 and waits for next actuation of the start pedal 38.

Upon second actuation of the start pedal 38, the main shaft 76 is again driven into rotation to effect sewing based on sewing instructions from sewing point P14 to sewing point P23 and sewing instructions for back tack from said sewing point P23 to sewing point P19 (P19 B). Thus, the needle 3 is halted at an elevated position, upper and lower threads are cut and the work holder 7 is shifted to sewing start point (P1) to complete one cycle sewing.

Figure 32:
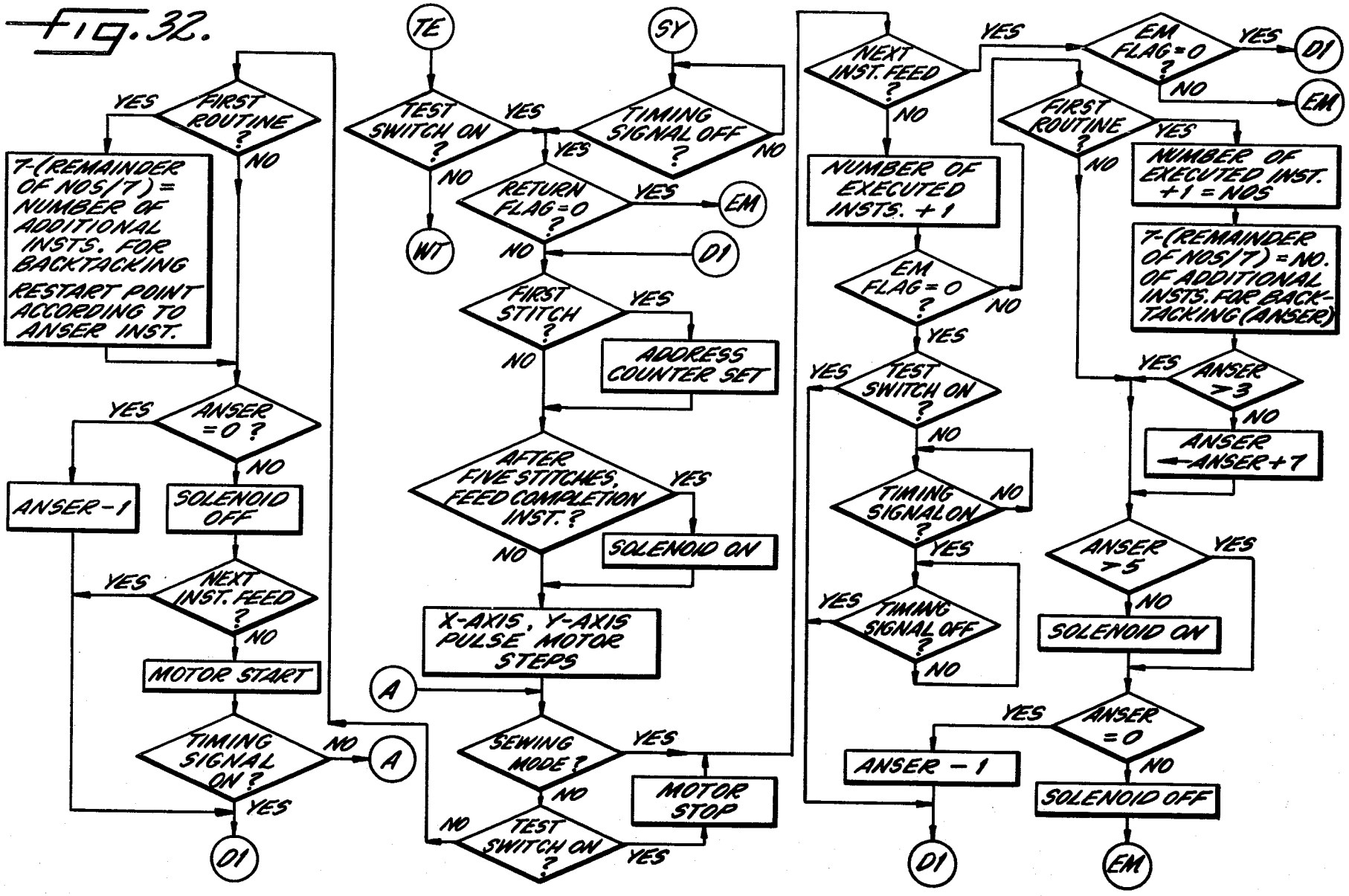
Figures 33, 34:
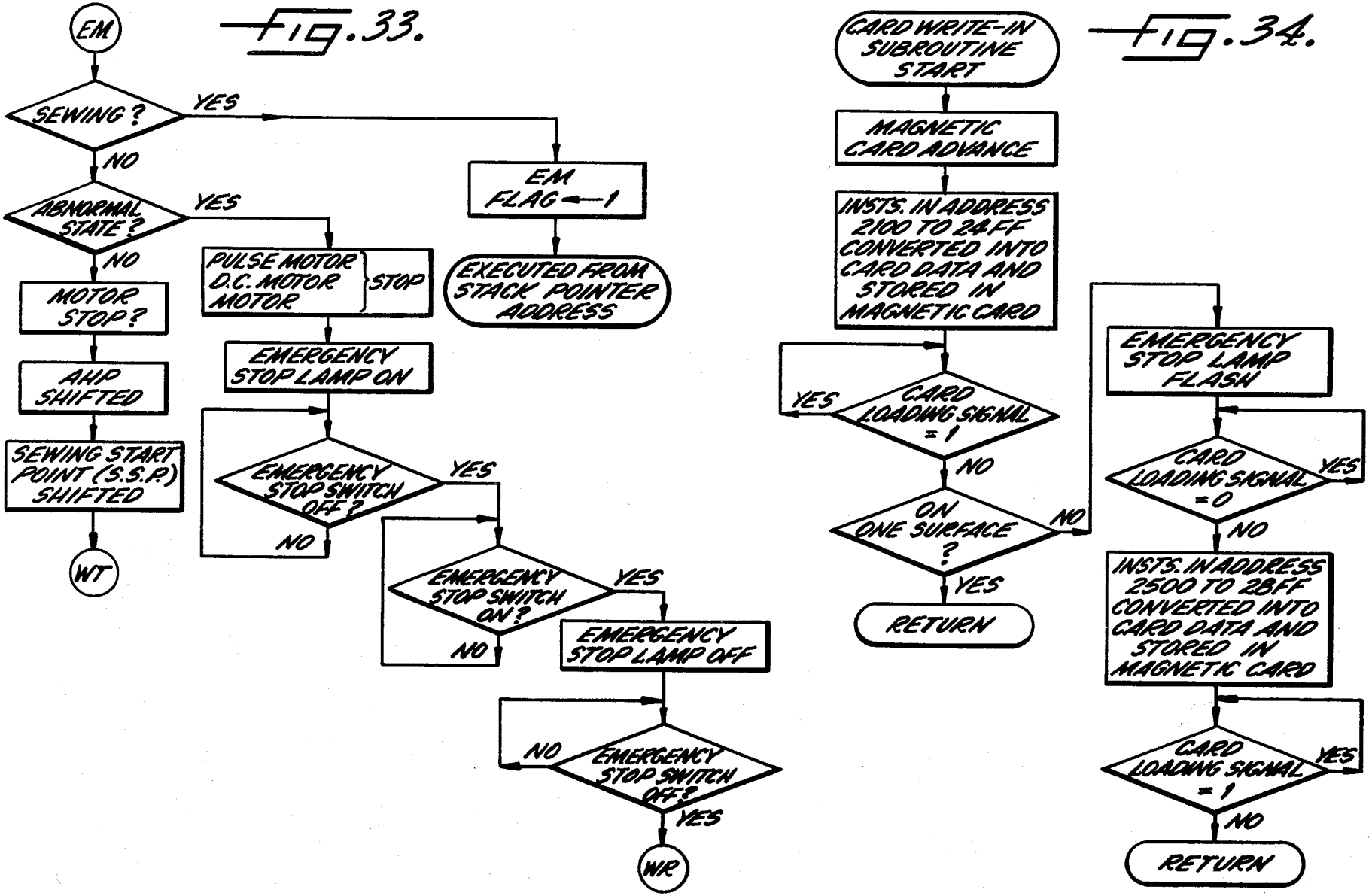

If the emergency stop switch 32 is pressed down for emergency stop during sewing, the C.P.U. 200 shifts to an interrupt routine shown in FIG. 33. In this routine, the mode is checked to be the sewing mode, the EM flag is set to "1", and the operational procedure so far performed in accordance with the flow chart shown in FIG. 32 is suspended at the stage of checking of the EM flag. The work holder 7 is halted at the end of seventh stitches, or as a unit of seven stitches.

Thus, after checking that EM flag is not "0", the C.P.U. 200 checks if this routine is executed for the first time, the C.P.U. 200 then calculates the number of additional instructions for back-tacking ANSER in the same way as described in connection with the card read operation, based on the execute instruction stitch number count stored in the number of stitches counter, and causes the solenoid 188 to be energized when the number of additional instructions for back-tacking is larger than "3" and smaller than "5" (that is, equal to "4"). After completion of sewing for four stitches, needle 3 is stopped at an elevated position and upper and lower threads are cut. The C.P.U. 200 then causes X-axis and Y-axis pulse motors 57, 58, D.C. motor 97 and motor 105 to be halted and emergency lamp 35 to be lighted.

For the number of additional instruction for back-tacking ANSER smaller than "3", emergency stop occurs at the time of completion of sewing for the number of stitches equal to the sum of the additional instructions for back-tacking ANSER and "7". Emergency stop will occur instantly when the emergency switch 32 is pressed during feed.

Emergency stop may be cancelled by again pressing the switch 32, with said switch 32 once reset and emergency lamp 32 turned off.

(v) Test Operation

Test operation in which the work holder 7 is tentatively shifted prior to the above sewing operation, based on sewing and feed instructions stored in sewing program area of RAM 202, will be explained. This test operation is intended for preventing collision of the work holder 7 against the presser foot 5 due to program error and may be effected with the test switch 31 turned on.

It is supposed that the work holder 7 has been returned to start point and the motor 105 is in operation with the data being read out from magnetic card 36. If then the self resetting type test switch 31 is pressed, the C.P.U. 200 effects an operational sequence in accordance with flow chart shown in FIG. 32 and already explained in conjunction with the above sewing operation. What occurs during pressing of this test switch 31 is the same as during the sewing operation described above, exept that motor 105 is stopped for safe test operation at the stage of check of sewing mode and on/off state of test switch 31 and that work holder 7 continues its cyclic movement from start point P1 to sewing point P19 (P19B) and back to start point P1 at the stage of check of the EM flag and test switch 31. Therefore, description is made below only of what occurs when the test switch 31 is turned off (pressure on the test switch 31 is released) during test operation.

With the test switch 31 turned off, at the stage of check of sewing mode and on/off state of the test switch 31, the C.P.U. 200 proceeds to a routine in which the work holder 7 is stopped at a unit of seven stitches (or after feed when the instructions next to the instructions for the seventh stitch are feed instructions).

After check that test switch 31 is not turned on, the C.P.U. 200 checks that the routine is being executed for the first time. If so, the C.P.U. 200 calculates the number of additional instructions for back-tacking ANSER in the same way as described above, causes the work holder 7 to travel for the number of additional instructions for back-tacking ANSER and be then halted, and starts the motor 105. The C.P.U. 200 causes the work holder 7 to be fed to sewing point P14 or to sewing start point P1 and be halted there, provided that the halt position of the work holder 7 is the sewing point P12 (P12B) or sewing point P19 (P19B).

In case of such accidents as thread breakage or shift of the work fabric 8 during sewing, work holder 7 is stopped at a predetermined sewing point by operation of the test switch 31 and then the start pedal 38 is pressed down. The main shaft 76 is driven immediately into rotation to restart sewing.

(vi) Instruction Correcting A Compensating Operation

The instruction correcting operation for correcting the sewing and feed instructions stored in sewing program area of RAM 202 will be explained. Correction of the instructions includes both the correction to change the sewing point position and the correction to cancel predetermined sewing point and description is first made of the former correction.

When the sewing point P5 for example is changed to sewing point P5A, as shown in FIG. 23, the numerical key "3" is first closed for digital display of "3" on numerical display section 28, and plus key 18 is closed. The C.P.U. 200 then proceeds to operational sequence in accordance with the flow chart shown in FIG. 27. At the stage of check that the address is at initial value (i.e. the instructions to shift from absolute home position PH to sewing start point P1), the C.P.U. 200 causes work holder 7 to shift one stitch based on sewing instructions from sewing point P1 to sewing point P2, increments the address, checks that cancel flag to be described is not "1" and changes the display on numerical display 28 from "3" to "2". By repetion of the similar operation, the C.P.U. 200 causes the work holder 7 to be stopped at sewing point P4, sets the display on numerical display section 28 to "0", sets the respective flags, causes the X-axis and Y-axis display sections 26 and 27 to display "0" and waits for the operation for shifting the work holder 7 to sewing point P5A.

On actuating the jog keys 20 to 23 in the same way as when programming shift the work holder 7 to sewing point P5A, and closing the load key 14, the C.P.U. 200 proceeds to execution of an operational sequence in accordance with flow chart shown in FIG. 26 and, at the stage of checking if there are instructions in the above address, proceeds to an operational sequence for correction or compensation. The C.P.U. 200 converts the sewing instructions from P5 to P6 into a pulse number, compares the number with a pulse number as counted at the two counters by renewed actuation of said jog keys 20 to 23, and calculates the distance between P5 and P6 (pulse number A). The C.P.U. 200 then checks that the instructions from P5 to P6 are not the feed instructions but the sewing instructions and stores said pulse number A as sewing instructions in operational area and in sewing program area in the same way as described above, to complete the correction of the sewing instructions at sewing point P5. If the instructions have turned out to be feed instructions, the pulse number A is stored as feed instructions in the sewing program area.

Next, the case of cancelling the sewing point P5 is explained. On closure of the numerical key "3" and the plus key 18 by the operator, the work holder is shifted to sewing point P4 in the same way as described above. Then, on closure of the cancel key 16, the cancel flag is set to "1" and the cancel lamp 25 is turned on. During operational sequence in accordance with flow chart shown in FIG. 27, the C.P.U. 200 checks whether the cancel key 16 has been closed, and then whether the instructions from sewing point P1 to sewing point P2 should be cancelled. If the instructions are those for P1 to P2, they are corrected to such instructions wherein sewing point P2 is the new sewing start point P1.

After the check that the sewing instructions P1 to P2 are not cancelled, the control C.P.U. 200 operates the second preceding instructions, in this case the sewing instructions for P4 to P6, converts the same into a pulse number A an stores it in operational area register. After the check that the instructions for P4 to P5 are not the feed instructions, the instructions stored in the operational area register are stored in the sewing program area and the sewing instructions for P4 to P5 are cancelled. In case the instructions for P4 to P5 are the feed instructions, said pulse number A is stored as feed instructions in the sewing program area through said operational area register.

It is to be noted that such cancelling may be effected by minus key 19. Thus, by operating the minus key 19, the operational sequence is executed in accordance with the flow chart shown in FIG. 28. In this case, cancel operation occurs while the work holder 7 is shifted in the reverse direction or towards a sewing point on the side of the sewing start point P1.

Lastly, the case of closing reset key 12 is explained.

Figure 25:
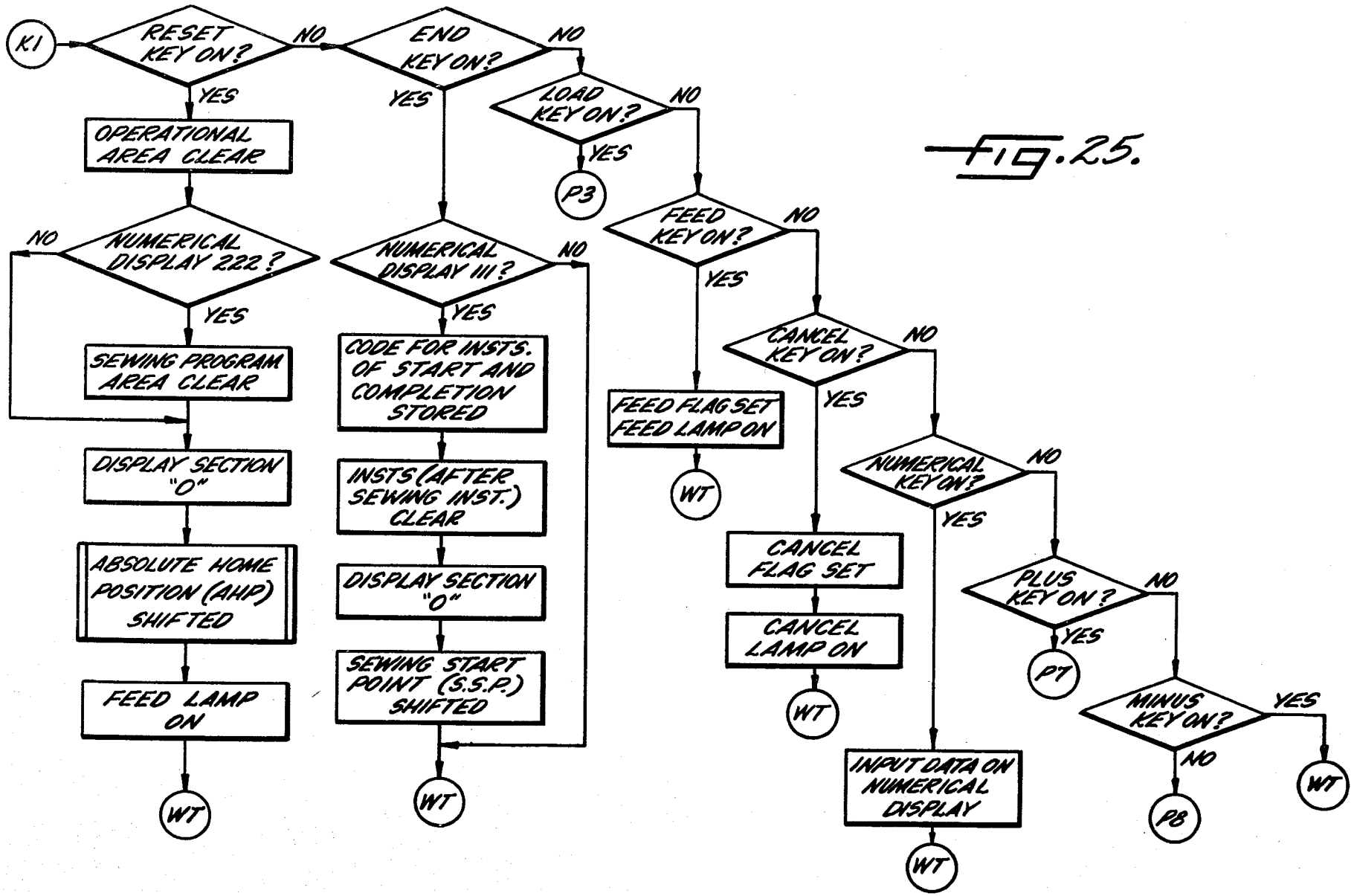
Figure 27:
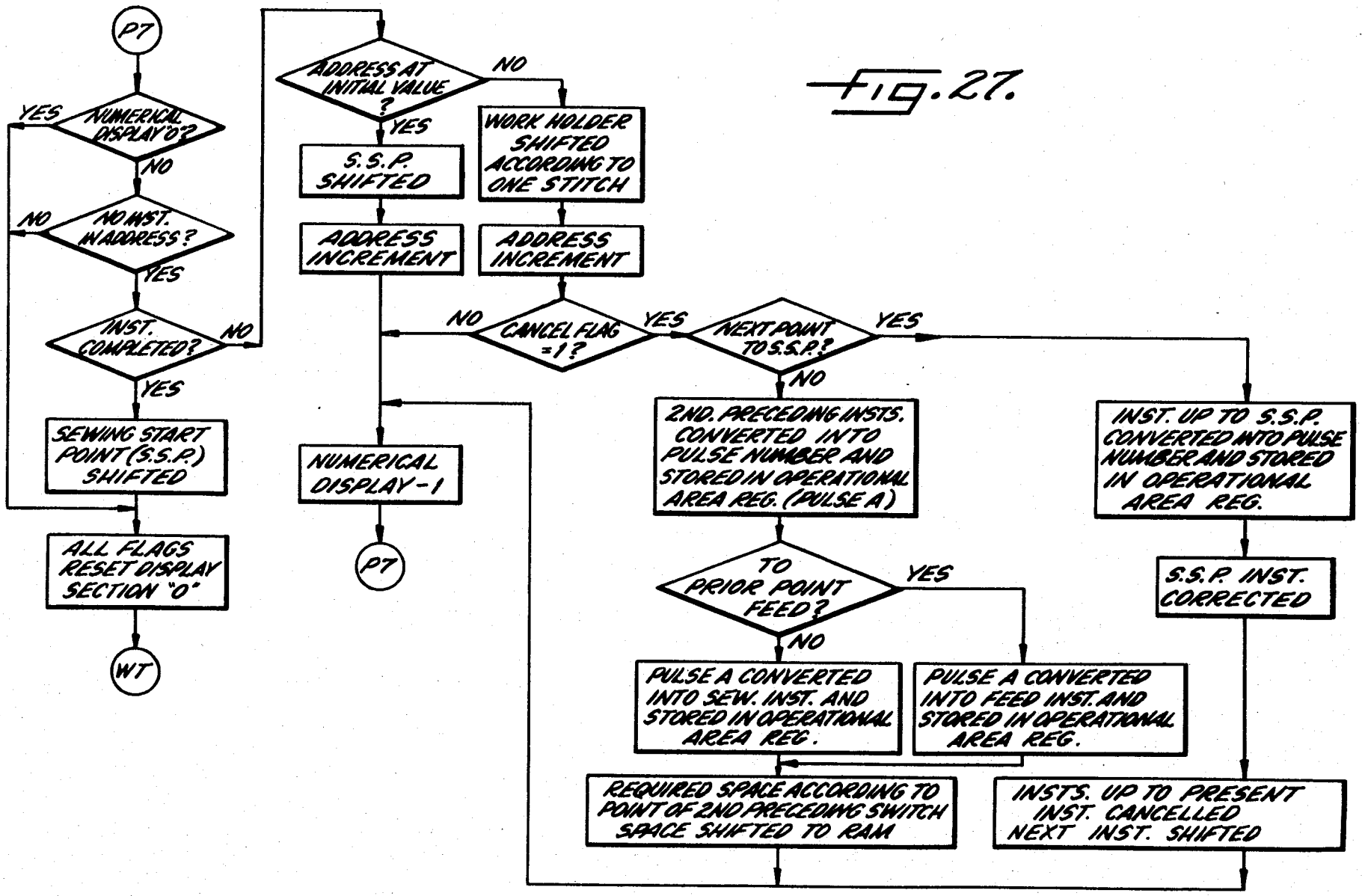

Upon three times closure of the numerical key "2" and closure of the reset key 12, the control C.P.U. 200 proceeds to execution of a flow chart shown in FIG. 25 to clear the operational area and sewing program area, display "0" in display sections 26 to 28, shift work holder 7 to absolute home point AHP and turn on feed lamp 24, in readiness for new program sequence initated by actuation of the jog keys 20 to 23 in the same way as described above. According to the present invention, when the X-axis and Y-axis jog keys are operated during programming operation for preparing the sewing and feed instructions at each sewing, the travel distance from one to the other sewing point of the work holder may be visually checked by the digital display in the X-axis and Y-axis display sections, program data for sewing and feed instructions may be prepared accurately. Moreover, the sewing instruction and feed instruction program may be easily stored and held on the magnetic card and reproduced therefrom to effect the sewing operation, based on card write and card read function. Moreover, during card read out operation, in case of inconsistency between the number of stitches obtained from the above instruction program and the number of stitches that may be halted by cam means, the number of stitches to the next stop point may be converted into additional instructions for back-tacking and may be stored in RAM. Thus, there is no necessity to take the number of stitches into account in the stage of program formulation.

In addition, the sewing and feed instructions stored in RAM may be corrected easily by instruction correcting operation, which is highly convenient, especially when desired to correct the data partially depending on the work fabric being sewed moreover, once the instructions are in the magnetic card, these may be re-stored in RAM at any later time to enable instant sewing.

In the above example, additional instructions for back-tacking are formulated during read out from magnetic card into RAM. However, such formulation may be made at any time prior to the start of sewing, as when correcting the programming or when preparing a subroutine to write into magnetic card. However, additional instructions for back-tacking may be formulated most preferably during reading into RAM as in the above example because the basic instructions as initially programmed and stored in the magnetic card are not changed at all and may subsequently be processed in any desired manner to effect various sewing.

In addition, because random access memory (RAM) is used as memory means, a variety of programming and instruction correcting operations may be made to enable variable programming and sewing operations. However, the present invention is not limited to the use of RAM and PROM as in the example shown but any other memory devices having the same function as RAM and PROM may be employed.

In addition, while the operative connection between stop control cam means and start stop means is validated by a solenoid, it is also possible to use suitable clutch means between main shaft and the above cam means so that the operative connection may be set at desired time by connecting said clutch means.

What we claimed is:

1. A sewing machine comprising; a frame including a work supporting bed, a main shaft journaled in said frame, a reciprocateable needle supported on said frame and movably connected with said main shaft, drive means for driving said main shaft, a motion control mechanism provided between said main shaft and said drive means for controlling the start and stop of said main shaft, cam means rotatably mounted on said frame and drivingly connected with said main shaft for controlling the operation of said motion control mechanism at the sewing cycle corresponding to a predetermined number of stitches, actuating means provided between said main shaft and said motion control mechanism for effecting the operation of said motion control mechanism according to the rotation of said cam means, a work holder movably supported on said work supporting bed across the reciprocating path of said needle, feed drive means for driving said work holder, memory means having a plurality of original instructions, each of said original instructions including positional data representing the moving position of said work holder and operational command for said actuating means, means for preparing at least one additional instruction corresponding to the number of stitches required to reach the next stop time point controlled by said cam means in case that the number of stitches corresponding to said original instructions are not consistent with a number of stitches equal to an integral multiple of said predetermined number of stitches, said at least one additional instruction including positional data representing the moving position of said work holder and operational command for said actuating means, and control means for operating said actuating means and said feed drive means according to said original instructions and said at least one additional instruction.

2. A sewing machine according to claim 1, wherein said feed drive means includes a pair of pulse motors.

3. A sewing machine according to claim 2, wherein each positional data of said original instructions and said additional instruction include a direction data and a drive pulse number data for said pulse motors respectively.

4. A sewing machine according to claim 3, wherein said direction data of said additional instruction represent reverse direction with respect to said direction data of said original instructions corresponding to said additional instruction, whereby the stitches formed by said additional instruction are performed on the stitches formed by said original instructions.

5. A sewing machine according to claim 1, wherein said actuating means includes a solenoid.

6. A sewing machine comprising; a frame including a work supporting bed, a main shaft journaled in said frame, a reciprocateable needle supported on said frame and movably connected with said main shaft, drive means for driving said main shaft, a motion control mechanism provided between said main shaft and said drive means for controlling the start and stop of said main shaft, cam means rotatably mounted on said frame and drivingly connected with said main shaft for controlling the operation of said motion control mechanism at the sewing cycle corresponding to a predetermined number of stitches, actuating means provided between said main shaft and said motion control mechanism for effecting the operation of said motion control mechanism according to the rotation of said cam means, a work holder movably supported on said work supporting bed across the reciprocating path of said needle, feed drive means for driving said work holder, first memory means having a plurality of original instructions, each of said original instructions including positional data representing the moving position of said work holder and operational command for said actuating means, means for preparing at least one additional instruction corresponding to the number of stitches required to reach the next stop time point controlled by said cam means in case that the number of stitches corresponding to said original instructions are not consistent with a number of stitches equal to an integral multiple of said predetermined number of stitches, said at least one additional instruction including positional data representing the moving position of said work holder and operational command for said actuating means, second memory means for storing said original instruction, and control means for operating said actuating means and said feed drive means according to both said instructions stored by said second memory means.

7. A sewing machine according to claim 6, wherein said first memory means include a magnetic card.

8. A sewing machine according to claim 6, wherein said second memory means include a random access memory.

9. A sewing machine comprising; a frame including a work supporting bed, a main shaft journaled in said frame, a reciprocateable needle supported on said frame and movably connected with said main shaft, drive means for driving said main shaft, a motion control mechanism provided between said main shaft and said drive means for controlling the start and stop of said main shaft, cam means rotatably mounted on said frame and drivingly connected with said main shaft for controlling the operation of said motion control mechanism at the sewing cycle corresponding to a predetermined number of stitches, actuating means provided between said main shaft and said motion control mechanism for effecting the operation of said motion control mechanism according to the rotation of said cam means, a work holder movably supported on said work supporting bed across the reciprocating path of said needle, feed drive means for driving said work holder, manually operable means for actuating said feed drive means without the reciprocation of said needle for the purpose of programming, first control means for preparing a plurality of original instructions according to the operation of said manually operable means, each of said original instructions including positional data representing the moving position of said work holder and operational command for said actuating means, memory means for storing said original instructions, means for preparing at least one additional instruction corresponding to the number of stitches required to reach the next stop time point controlled by said cam means in case that the number of stitches corresponding to said original instructions are not consistent with a number of stitches equal to an integral multiple of said predetermined number of stitches, said at least one additional instruction including positional data representing the moving position of said work holder and operational command for said actuating means, and second control means for operating said actuating means and said feed drive means according to said original instructions and said at least one additional instruction.

10. A sewing machine comprising; a frame including a work supporting bed, a main shaft journaled in said frame, a reciprocateable needle supported on said frame and movably connected with said main shaft, drive means for driving said main shaft, a motion control mechanism provided between said main shaft and said drive means for controlling the start and stop of said main shaft, cam means rotatably mounted on said frame and drivingly connected with said main shaft for controlling the operation of said motion control mechanism at the sewing cycle corresponding to a predetermined number of stitches, actuating means provided between said main shaft and said motion control mechanism for effecting the operation of said motion control mechanism according to the rotation of said cam means, a work holder movably supported on said work supporting bed across the reciprocating path of said needle, feed drive means for driving said work holder, manually operable means for actuating said feed drive means without the reciprocation of said needle for the purpose of programming, first control means for preparing a plurality of original instructions according to the operation of said manually operable means, each of said original instructions including positional data representing the moving position of said work holder and operational command for said actuating means, internal memory means for temporarily storing said original instructions, external memory means for storing said original instructions, means for bidirectionally transferring said original instructions between said internal memory means and said external memory means, means for preparing at least one additional instruction corresponding to the number of stitches required to reach the next stop time point controlled by said cam means in case that the number of stitches corresponding to said original instructions transfered into said internal memory means from said external memory means are not consistent with a number of stitches equal to an integral multiple of said predetermined number of stitches, said at least one additional instruction including positional data representing the moving position of said work holder and operational command for said actuating means, means for inserting said at least one additional instruction into said original instructions which are transferred into said internal memory means from said external memory means, and second control means for operating said actuating means and said feed drive means according to said both instructions stored in said internal memory means.

* * * * *